US011824307B2

(12) United States Patent
Munch

(10) Patent No.: US 11,824,307 B2
(45) Date of Patent: Nov. 21, 2023

(54) ELECTRICAL CONNECTOR AND CONNECTOR ELEMENTS FOR A MODULAR CONSTRUCTION ELEMENT AND/OR SYSTEM

(71) Applicant: LEGO A/S, Billund (DK)

(72) Inventor: Gaute Munch, Langå (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 17/512,286

(22) Filed: Oct. 27, 2021

(65) Prior Publication Data

US 2022/0123505 A1 Apr. 21, 2022

Related U.S. Application Data

(62) Division of application No. 15/571,676, filed as application No. PCT/EP2016/060076 on May 4, 2016, now Pat. No. 11,217,937.

(30) Foreign Application Priority Data

May 6, 2015 (DK) ..... PA 2015 70264

(51) Int. Cl.
*H01R 13/627* (2006.01)
*H01R 13/58* (2006.01)
*A63H 33/04* (2006.01)

(52) U.S. Cl.
CPC ..... *H01R 13/6273* (2013.01); *A63H 33/042* (2013.01); *H01R 13/5833* (2013.01); *H01R 13/6275* (2013.01)

(58) Field of Classification Search
CPC ..... H01R 13/5833; H01R 13/6273; H01R 13/6275; A63H 33/042
See application file for complete search history.

(56) References Cited

U.S. PATENT DOCUMENTS 4,532,579 A 7/1985 Merryman
4,681,382 A 7/1987 Lockard
(Continued)

FOREIGN PATENT DOCUMENTS

CN 101896239 A 11/2010
CN 102228745 A 11/2011
(Continued)

OTHER PUBLICATIONS

First Office Action issued in corresponding Chinese patent application No. 201680040264.7, dated Jan. 29, 2019 (English translation only).

(Continued)

*Primary Examiner* — Oscar C Jimenez
(74) *Attorney, Agent, or Firm* — Day Pitney LLP; Anthony A. Kassas

(57) ABSTRACT

The presentation invention relates to a first electrical connector element for a modular construction element and/or system, including a first connector part having a plurality of electrical contacts electrically connected to a plurality of electrical conductors. The first electrical connector is adapted to connect with a second electrical connector element, and includes a strain relief part to securely hold the plurality of electrical conductors thereby securing the plurality of electrical conductors to the first electrical connector element. The first electrical connector also includes a number of lock and release elements for engaging with the second electrical connector element when mechanically and electrically coupled together and releasing the coupling of the first and the second electrical connector elements when subjected to one or more pull forces above a predetermined release threshold.

17 Claims, 12 Drawing Sheets

(56) References Cited

U.S. PATENT DOCUMENTS

| | | | |
|---|---|---|---|
| 4,762,505 | A | 8/1988 | Asick et al. |
| 4,824,394 | A | 4/1989 | Roath et al. |
| 5,011,424 | A | 4/1991 | Simmons |
| 5,147,215 | A | 9/1992 | Pritulsky |
| 5,171,161 | A | 12/1992 | Kachlic |
| 5,449,298 | A | 9/1995 | Fetterolf, Sr. et al. |
| 5,564,950 | A | 10/1996 | Oman et al. |
| 5,593,315 | A | 1/1997 | Kinoshita et al. |
| 5,833,465 | A | 11/1998 | Jarzewiak |
| 6,089,898 | A | 7/2000 | Lincoln, III et al. |
| 6,203,354 | B1 | 3/2001 | Kuwahara et al. |
| 6,203,359 | B1 | 3/2001 | Lee |
| 6,290,540 | B1 | 9/2001 | Nishio et al. |
| 6,945,807 | B1 | 9/2005 | Wu |
| 7,601,010 | B1 | 10/2009 | Wu |
| 8,371,894 | B1 | 2/2013 | Rosen et al. |
| 8,932,084 | B2 | 1/2015 | Thackston et al. |
| 9,647,388 | B1 | 5/2017 | Ray et al. |
| 9,728,913 | B2 | 8/2017 | Tong et al. |
| 9,905,969 | B1 | 2/2018 | Baldwin et al. |
| 11,217,937 | B2 * | 1/2022 | Munch ..... H01R 13/5833 |
| 2002/0173191 | A1 | 11/2002 | I-Tse |
| 2005/0181661 | A1 | 8/2005 | Kaneko et al. |
| 2005/0250373 | A1 | 11/2005 | Nakano et al. |
| 2006/0068636 | A1 | 3/2006 | Meleck et al. |
| 2006/0216976 | A1 | 9/2006 | Oma et al. |
| 2006/0271136 | A1 | 11/2006 | Wojciechowicz |
| 2007/0178730 | A1 | 8/2007 | Major et al. |
| 2007/0184722 | A1 | 8/2007 | Doherty |
| 2008/0200058 | A1 | 8/2008 | Tsai |
| 2008/0299811 | A1 | 12/2008 | Battista |
| 2009/0239406 | A1 | 9/2009 | Amidon |
| 2009/0305602 | A1 | 12/2009 | Gaute |
| 2010/0015826 | A1 | 1/2010 | Daily et al. |
| 2010/0268858 | A1 | 10/2010 | Lee |
| 2010/0285683 | A1 | 11/2010 | Zhang |
| 2010/0285684 | A1 | 11/2010 | Zhang |
| 2010/0311300 | A1 | 12/2010 | Hansen et al. |
| 2011/0244730 | A1 | 10/2011 | Kondo et al. |
| 2011/0312207 | A1 | 12/2011 | Chapel et al. |
| 2012/0252255 | A1 | 10/2012 | Colantuono et al. |
| 2013/0196530 | A1 | 8/2013 | Cheatham et al. |
| 2013/0217253 | A1 | 8/2013 | Golko et al. |
| 2013/0244472 | A1 | 9/2013 | Weber et al. |
| 2014/0073170 | A1 | 3/2014 | Golko et al. |
| 2014/0273711 | A1 | 9/2014 | Capriola |
| 2015/0155657 | A1 | 6/2015 | Golko et al. |
| 2015/0229073 | A1 | 8/2015 | Katayanagi |
| 2018/0123285 | A1 | 5/2018 | Nakamura |

FOREIGN PATENT DOCUMENTS

| | | | |
|---|---|---|---|
| CN | 103378477 | A | 10/2013 |
| CN | 203326271 | U | 12/2013 |
| CN | 203932491 | U | 11/2014 |
| DE | 19961653 | A1 | 7/2000 |
| EP | 0945920 | A1 | 9/1999 |
| EP | 0952630 | A2 | 10/1999 |
| EP | 2672594 | A1 | 12/2013 |
| WO | 2008/092187 | A1 | 8/2008 |
| WO | 2009/047225 | A1 | 4/2009 |
| WO | 2009/059269 | A1 | 5/2009 |

OTHER PUBLICATIONS

International Search Report issued in corresponding international patent application No. PCT/EP2016/060076, dated Jul. 4, 2016.

Written Opinion issued in corresponding international patent application No. PCT/EP2016/060076, dated Jul. 4, 2016.

International Preliminary Report on Patentability issued in corresponding international patent application No. PCT/EP2016/060076, dated Jul. 18, 2017.

LEGO Group: "Mindstorm EV3 User Guide", Sep. 4, 2013. https://web.archive.org/web/20130904044046/http://cache.1ego.com/r/www/r/mindstorms/-/media/Franchises/Mindstorms/Retail/Downloads/USer Guides/ts.20130821T090518. [retrieved from Internet: Jun. 22, 2016].

LEGO Group: "Mindstorm EV3 Temperature Sensor", Sep. 4, 2013 https://web/archive.org/web/20130904041246/http://www.lego.com/en-us/mindstorms/downloads/ev3-blocks/temperature [retrieved from Internet: Jun. 22, 2016].

* cited by examiner

ELECTRICAL CONNECTOR AND CONNECTOR ELEMENTS FOR A MODULAR CONSTRUCTION ELEMENT AND/OR SYSTEM

CROSS-REFERENCE TO RELATED APPLICATIONS

This application is a Divisional Application of U.S. patent application Ser. No. 15/571,676, filed on 3 Nov. 2017 and published on 24 May 2018 as U.S. Published Application 2018/0145448, which is a U.S. National Stage of International Application No. PCT/EP2016/060076, filed on 4 May 2016 and published on 10 Nov. 2016, as WO 2016/177823 A1, which claims the benefit of priority to Danish Patent Application No. DK PA201570264, filed on 6 May 2015. The contents of each of the above referenced patent applications is incorporated herein by reference in its entirety for any purpose whatsoever.

FIELD OF THE INVENTION

The present invention relates generally to an electrical connector and connector elements thereof for a modular construction element and/or system.

BACKGROUND

Many different types of electrical connectors exist today.

Certain types of connectors are based on the well-known RJ12 (registered jack) connector having a male plug and a female jack that especially is used for connecting telecommunications or data equipment but also have found use in other equipment.

The plug and jack of a RJ12 connector (and many more RJ connectors) snap or click together using a locking element requiring a press on a fairly small surface before they safely can be separated again. This way of separation is and not very suitable for certain types of users, e.g. (young) children; especially if a small form factor of the connector also is preferred.

If the RJ12 or a similar connector is used to connect to a device, it is fairly easy to break the connector, or rather the locking element of it, e.g. if a person inadvertently trips in or otherwise gets caught by the wire of the connector. This is especially the case if the device is used on the floor, which quite often can be the case for certain devices like toys, etc. Furthermore, the device itself may also get pulled (both if the connector breaks and not) risking breaking or damaging the device as well.

Often standard RJ12 and similar connectors are equipped with fairly rigid wires, which do not make them particular useful for certain connections Patent specification U.S. Pat. No. 5,171,161 discloses an electrical connector assembly including a plug connector assembly mateable with a right angle header connector assembly. When an operator wishes to unmate the disclosed connector assemblies, the operator grasp a cover in an indicated direction to unlock the connector assemblies from each other and thereby allow separation.

Patent specification DE 199 61 653 discloses a coupling head for an electrical conducting coupling device for train models where wires is connected to a model vehicle through open cable ducts.

Patent specification EP 2 672 594 discloses a vehicle-mounted cable mounted in a vehicle having a cable port where a first cable can be pulled out through the cable port and a connection device connecting the first cable with a second cable.

Patent specification U.S. Pat. No. 5,449,298 discloses a latching system for a pair of intermatable electrical connectors and a mechanism for unlatching the same by an application of a maximum predetermined separating force, such as may be the result of an accident.

Patent application US 2006/068636 discloses a cord set for connecting electrical household items in a sleeper cabin of a vehicle, such as a heavy duty truck, with a power outlet and disengaging them again e.g. if the truck accidentally is driven away without un-plugging.

Patent application WO 2009/059269 discloses a telecommunications plug comprising a plug body where a plug latches on the plug body.

Patent application WO 2008/092187 discloses a socket and plug for an electrical connector arrangement that are designed so that the contact blades of the plug are elongate and oriented transverse to the body of the plug and the direction of connection is parallel to the plane of the blades and transverse to the major axis of the contact blades.

Patent application US 2013/196530 discloses a power adapter cord for providing electrical power to an electronic item of merchandise. The connector and the corresponding connector defines a mechanical and electrical connection having a connector extraction force greater than the connector extraction for of a standard connector of the same type. Accordingly, the connector prevents accidental or malicious removal of the connector from the power input port and/or discourages theft of the item of merchandise because the connector cannot be forcibly removed without damaging the corresponding connector and thereby rendering the item of merchandise inoperable.

Publication "Mindstorm EV3 User Guide" discloses modular construction elements and systems having electrical connectors of the above mentioned RJ12 type.

Publication "Mindstorm EV3 Temperature sensor" discloses a modular construction element comprising a temperature sensor having a connector of the above mentioned RJ12 type.

Needing to unlock the connectors before separation is possible is not very intuitive. Especially for certain types of users such as children or young children.

Additionally, many types of existing connectors are not suitable for use and/or integration with one or more modular construction elements and/or a system of such.

There is therefore a need for a connector and connector elements that alleviate one or more of the above mentioned drawback at least to some extent; especially for users such as (young) children.

SUMMARY

According to a first aspect, disclosed herein is a first electrical connector element for a modular construction element and/or system, the first electrical connector element comprising a first connector part comprising a plurality of electrical contacts electrically connected to a plurality of electrical conductors, wherein the first electrical connector element is adapted to be mechanically, electrically, and releasably connected with a second electrical connector element, and wherein the first electrical connector element further comprises a strain relief part adapted to securely hold the plurality of electrical conductors thereby securing the plurality of electrical conductors to the first electrical connector element, and a number of lock and release elements adapted to engage with the second electrical connector element when the first and the second electrical connector elements are mechanically and electrically coupled together thereby locking a coupling between the first and the second electrical connector elements and further being adapted to release the coupling between the first and the second electrical connector elements when the first and/or the second electrical connector element is/are subjected to one or more pull forces above a predetermined release threshold.

Accordingly, an electrical connector element is provided facilitating simple and reliable connection and disconnection, even by users such as children and even after repeated use (connection/disconnection). A user may simply pull the first and second electrical connector elements apart by applying a resulting force in an un-mating direction (being parallel and opposite to a mating direction) being larger than the predetermined release threshold.

By being subjected to pull forces or one or more pull forces is to be understood as being subjected to a resulting pull force (e.g. comprising a plurality of pull force components) generally in the un-mating direction.

In some embodiments, the number of lock and release elements is/are adapted to release the coupling between the first and the second electrical connector elements when the plurality of electrical conductors, e.g. in the form of a wire, cable, etc., is subjected to one or more pull forces above the predetermined release threshold.

In this way, a user may simply pull the electrical conductors (or wire, cable, etc. comprising the electrical conductors) with a sufficient resulting force in the un-mating direction being larger than the predetermined release threshold.

In some embodiments, the predetermined release threshold is a member selected from the group consisting of: 5 or more Newton, 7.5 or more Newton, 10 or more Newton, or 15 or more Newton. The actual predetermined threshold may vary according to specific embodiment.

In some embodiments, the predetermined release threshold is a value selected from the interval of about 5 to about 15 Newton (e.g. the interval of 5 to 15 Newton).

In some embodiments, the first and/or second electrical connector element is/are adapted to release from each other at least when being subjected to one or more pull forces being 15 or more Newton and adapted to not release when being subjected to one or more pull forces being 5 or less Newton.

In some embodiments, the first electrical connector element is a male plug connector.

In some embodiments, the first electrical connector element comprises two or more lock and release elements and/or wherein the lock and release elements comprises snap fit elements fitting with snap fit elements of the second electrical connector element.

In some embodiments, the lock and release elements comprises pegs or resilient legs comprising an engaging portion, e.g. an engaging end portion, adapted to engage with a receiving opening or recess of the second electrical connector element when the first and the second electrical connector elements are mechanically and electrically coupled together.

In some embodiments, a protruding part of the first electrical connector element is received in an opening of the second electrical connector element when the first and the second electrical connector elements are mechanically and electrically coupled together, where the protruding part comprises the electrical contacts, at least a part of the electrical conductors, and the lock and release elements.

In some embodiments, the electrical contacts each are adapted to make electrical contact with an electrical contact of the second electrical connector element and wherein the electrical contacts of the second electrical connector element are located in a number grooves guiding at least a part of the electrical contacts of the first electrical connector element when the first and the second electrical connector elements are mechanically and electrically coupled together.

In some embodiments, the strain relief part is adapted to securely hold the plurality of electrical conductors when being assembled with the first connector part.

In some embodiments, the strain relief part is adapted to bend the plurality of electrical conductors at least once, e.g. twice (e.g. as shown in FIG. 3) or four times (e.g. as shown in FIG. 5), when securely holding the plurality of electrical conductors.

In some embodiments, the strain relief part is adapted to bend the plurality of electrical conductors an even number of times.

In some embodiments, a housing of the first electrical connector element comprises a recess where the plurality of electrical conductors exits the housing, the recess allowing the plurality of electrical conductors to bend, outside the housing, away from or across a mating direction (or correspondingly the parallel opposite un-mating direction) without extending further than a length of the housing in the mating direction.

This is especially advantageous when using such a first electrical connector element together with one or more modular construction elements and/or a system of such since the plurality of electrical conductors then easily may bend 'out of the way', especially if the plurality of electrical conductors is flexible, so as to no interfere or obstruct with otherwise adjacent modular construction elements (e.g. as illustrated in FIGS. 11*a*) upper right and lower right figures, 11*b*) lower right figure, and 11*c*) upper and lower right figures).

In some embodiments, the plurality of electrical conductors exits the first electrical connector element in a direction being substantially parallel to an un-mating direction. This facilitates reliable and intuitive un-mating or un-coupling of the first and second electrical connector elements from each other by a user pulling the plurality of electrical conductors (or wire, cable, etc. comprising the electrical conductors).

In some embodiments, the plurality of electrical conductors is formed at least in part as a flexible and/or flat cable.

In some embodiments, the plurality of electrical conductors has a maximum width being at most about 8 millimetres.

The present disclosure relates to different aspects including the first electrical connector elements described above, and in the following corresponding second electrical connector elements, electrical devices, electrical cables, connected electric devices, an electrical system, modular construction elements, and modular construction systems, each yielding one or more of the benefits and advantages described in connection with the first mentioned aspect, and each having one or more embodiments corresponding to the embodiments described in connection with the first mentioned aspect and/or disclosed in the appended claims.

In particular, according to one aspect, disclosed herein is a second electrical connector element for a modular construction element and/or system, the second electrical connector element comprising a housing or main part comprising a plurality of electrical contacts electrically connected to a plurality of electrical conductors, wherein the second electrical connector element is adapted to, during use, be mechanically, electrically, and releasably connected with a first electrical connector element, and wherein the second electrical connector element further comprises an opening adapted to receive and engage with a number of lock and release elements of the first electrical connector element when the first and the second electrical connector elements are mechanically and electrically coupled together thereby locking a coupling of the first and the second electrical connector elements and further being adapted to release the coupling of the first and the second electrical connector elements when the first electrical connector element is subjected to one or more pull forces above a predetermined release threshold.

In some embodiments, the number of lock and release elements is/are adapted to release the coupling between the first and the second electrical connector elements when the plurality of electrical conductors is subjected to one or more pull forces above the predetermined release threshold.

In some embodiments, the predetermined release threshold is a member selected from the group consisting of: 5 or more Newton, 7.5 or more Newton, 10 or more Newton, or 15 or more Newton. The actual predetermined threshold may vary according to specific embodiment.

In some embodiments, the second electrical connector element is a female jack connector.

In some embodiments, the second electrical connector element comprises snap fit elements and the lock and release elements of the first electrical connector element are snap fit elements fitting with the snap fit elements of the second electrical connector element.

In some embodiments, the lock and release elements of the first electrical connector element comprises pegs or resilient legs, each comprising an engaging portion, e.g. an engaging end portion, and wherein the second electrical connector element further comprises one or more receiving openings or recesses adapted to engage with the engaging portion of one or more pegs or resilient legs when the first and the second electrical connector elements are mechanically and electrically coupled together.

In some embodiments, the opening is adapted to receive a protruding part of the first electrical connector element when the first and the second electrical connector elements are mechanically and electrically coupled together, where the protruding part comprises a plurality of electrical contacts, at least a part of a plurality of electrical conductors, and the lock and release elements of the first electrical connector element.

In some embodiments, the electrical contacts each are adapted to make electrical contact with an electrical contact of the first electrical connector element and are located in a number grooves guiding at least a part of the electrical contacts of the first electrical connector element when the first and the second electrical connector elements are mechanically and electrically coupled together.

In some embodiments, the second electrical connector element further comprises at least one securing element for securing or mounting the second electrical connector element.

In some embodiments, the second electrical connector element is configured as a simple output port, an advanced output port, an input port, or a combined input/output port.

Furthermore, according to one aspect, disclosed herein is the first electrical connector element and/or the second electrical connector element, wherein the first electrical connector element and/or the second electrical connector element comprises six electrical conductors and wherein a first electrical conductor comprises, during use, a first device control signal (M0), optionally supplying electrical power, or no signal (forth equally being a 'not used' signal), a second electrical conductor comprises, during use, a second device control signal (M1) or no signal, a third electrical conductor comprises, during use, an electrical ground potential signal (GND), a fourth electrical conductor comprises, during use, a power supplying signal (PWR) or no signal, a fifth electrical conductor comprises, during use, a first digital communications signal (DIG0), e.g. a digital output signal, and a sixth electrical conductor comprises, during use, a second digital communications signal (DIG1), e.g. a digital input signal.

According to one aspect, disclosed herein is the first electrical connector element and/or the second electrical connector element, wherein one of the plurality of electrical contacts of the first and/or second electrical connector element is offset compared to the other electrical contacts so that electrical connection for this electrical contact will be established before electrical connection for the others, during use, and where the offset electrical contact is the electrical contact having, in use, an electrical ground potential signal (GND).

According to yet another aspect, disclosed herein is an electrical device comprising a first electrical connector element and/or a second electrical connector element.

In some embodiments, the electrical device comprises one or more of:

a power source, optionally configured for supplying power, via the second electrical connector element and/or the first electrical connector element, to a connected electric device, user input element, a wireless communications element, one or more standard connectors, and one or more microprocessors.

In some embodiments, the electrical device is connected to a connected electric device via the first and/or the second electrical connector element.

According to yet a further aspect, disclosed herein is an electrical connector comprising a first electrical connector and a second electrical connector element.

According to yet a further aspect, disclosed herein is an electrical cable comprising a first electrical connector element and/or a second electrical connector element.

According to yet another aspect, disclosed herein is an electrical cable comprising a first electrical connector element at a first end and a further first electrical connector element or a connected electric device at its other end.

According to another aspect, disclosed herein is a connected electric device comprising a first electrical connector element and/or a second electrical connector element.

In some embodiments, the connected electric device is adapted to supply a signal identifying an identity and/or type of the connected electric device to another electrical device.

In some embodiments, the connected electric device is a device at least one of the following: a motor, a servo motor, a tacho motor, a lighting element, a sensor, an analog touch-based switch, a digital sensor, a linear actuator, a trigger and/or shooter element, an electro magnet, a relay, a sound generator and/or device, a display, a pneumatic valve, a pump, a light sensor, colour sensor, sound sensor, movement sensor, tilt sensor, distance sensor, acceleration sensor, position sensor, compass, direction sensor, pressure sensor, magnetism sensor, force sensor, near field communication detector, radio frequency communicator, and a remote control device.

According to yet another aspect, disclosed herein is a modular construction element comprising a first electrical connector element and/or a second electrical connector element.

In some embodiments, the modular construction element comprises an electrical device.

In some embodiments, the modular construction element comprises a connected electric device.

According to yet another aspect, disclosed herein is a modular construction system comprising a plurality of modular construction elements, wherein at least one of the plurality of modular construction elements comprises a first electrical connector element and/or a second electrical connector.

According to yet a further aspect, disclosed herein is a modular construction system comprising a plurality of modular construction elements, wherein at least one of the plurality of modular construction elements is a modular construction element.

According to another aspect, disclosed herein is an electrical system comprising a first electrical device and a second electrical device, the first electrical device comprising a first electrical connector element (100), the second electrical device comprising a second electrical connector element (200).

In some embodiments, the first and the second electrical connector element each comprises a first electrical conductor,
a second electrical conductor,
a third electrical conductor,
a fourth electrical conductor,
a fifth electrical conductor, and
a sixth electrical conductor, and wherein the first electrical device and the second electrical device are arranged to communicate

- a first device control signal (M0), optionally supplying electrical power, or no signal via the respective first electrical conductors,
- a second device control signal (M1) or no signal via the respective second electrical conductors,
- an electrical ground potential signal (GND) via the respective third electrical conductors,
- a power supplying signal (PWR) or no signal via the respective fourth electrical conductors,
- a first digital communications signal (DIG0), e.g. a digital output signal, via the respective fifth electrical conductors, and
- a second digital communications signal (DIG1), e.g. a digital input signal, via the respective sixth electrical conductors.

In some embodiments, the first electrical device and/or the second electrical device is or are an electrical device as described elsewhere in the description (e.g. designated 700) or a connected electrical device as described elsewhere in the description (e.g. designated 710).

In some embodiments, electrical cables comprising one or more first and/or second electrical connector elements acting as extension cables or 'series' elements may have means for preventing unsuitable chaining of such cables (e.g. preventing one series element to be connected to another series element) to ensure reliable operations of electrical devices.

The term modular construction elements and modular construction systems (i.e. systems comprising modular construction elements) are to be construed as comprising modular construction elements/system used as toys, for educational purposes, etc.

DETAILED DESCRIPTION

Various aspects and embodiments of a first and a second electrical connector element, of electrical devices, of electrical cables, of connected electric devices, of an electrical system, of modular construction elements, and of modular construction systems as disclosed herein will now be described with reference to the figures.

If/when relative expressions such as "upper" and "lower", "right" and "left", "horizontal" and "vertical", "clockwise" and "counter clockwise" or similar are used in the following terms, these only refer to the appended figures and not necessarily to an actual situation of use. The shown figures are schematic representations for which reason the configuration of the different structures as well as their relative dimensions are intended to serve illustrative purposes only.

Some of the different components are only disclosed in relation to a single embodiment of the invention, but is meant to be included in the other embodiments without further explanation.

Figure 1:
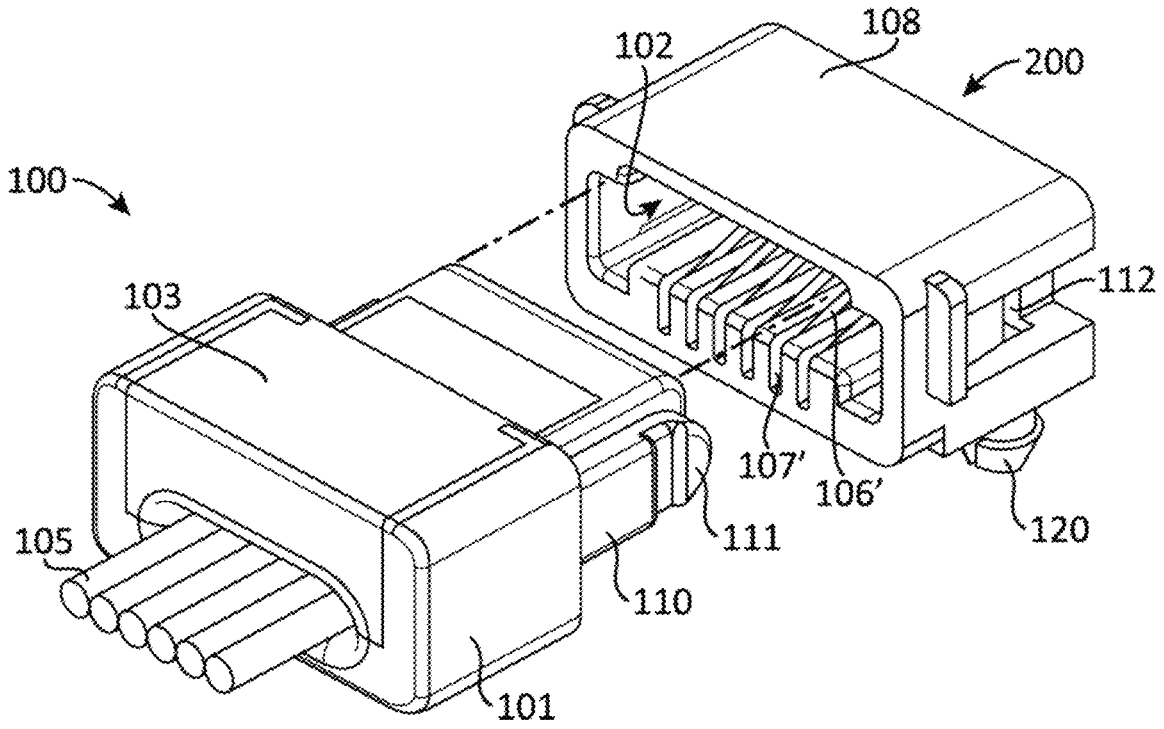
FIG. 1 schematically illustrates one embodiment of a first electrical connector element and one embodiment of a second electrical connector element together forming one embodiment of an electrical connector.

FIG. 1 schematically illustrates one embodiment of a first electrical connector element and one embodiment of a second electrical connector element together forming one embodiment of an electrical connector.

Shown is one embodiment of a first electrical connector element 100 and a second electrical connector element 200 where the first electrical connector element 100 is adapted, during use, to be mechanically, electrically, and releasably connected and coupled with the second electrical connector element 200 thus forming one embodiment of an electrical connector 100; 200. The first electrical connector element 100 is coupled to the second electrical connector element 200 by (relatively) moving the first electrical connector element 100 along a mating direction and they are separated again by (relatively) moving the first electrical connector element 100 along an un-mating direction (being parallel and opposite to the mating direction). It is to be understood, that the first electrical connector element 100 may be held still while moving the second electrical connector element 200 (then in the direction called un-mating direction above; thus the use of relatively moving.

The electrical connector and its first and second connector elements are preferably for use in or with a modular construction element and/or system as will be explained further e.g. in connection with FIGS. 10 and 11*a*)-11*d*).

In the shown and similar embodiments, the first electrical connector element 100 is a male plug connector while the second electrical connector element 200 is a female jack connector. As alternatives for all embodiments throughout the description, the first electrical connector element 100 and the second electrical connector element 200 may be a female jack connector and a male plug connector, or a male jack connector and a female plug connector, or a female plug connector and a male jack connector, respectively.

The first electrical connector element 100 comprises a first or main connector part 101 comprising a plurality of electrical contacts (not shown; see e.g. 106 in FIGS. 2, 3, and 4), e.g. in the form of metal terminals or the like, and a plurality of electrical conductors 105, e.g. in the form of wires. The electrical contacts are secured and electrically connected, e.g. at an end of the electrical conductors, typically with one contact being connected to one conductor.

Figure 3:
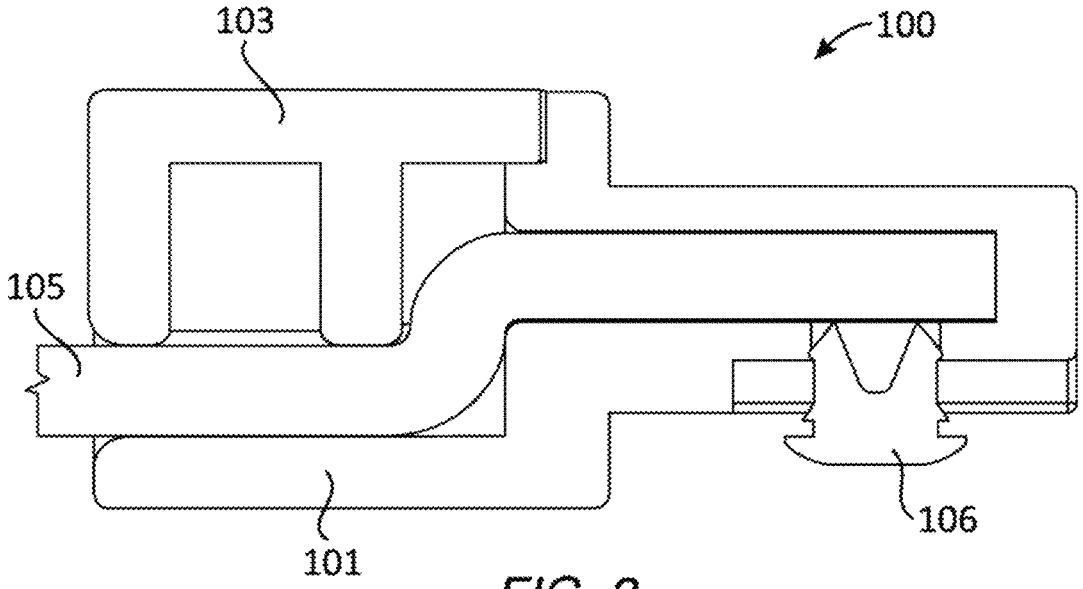
FIG. 3 schematically illustrates a cross section of one embodiment of a first electrical connector element.
Figure 4:
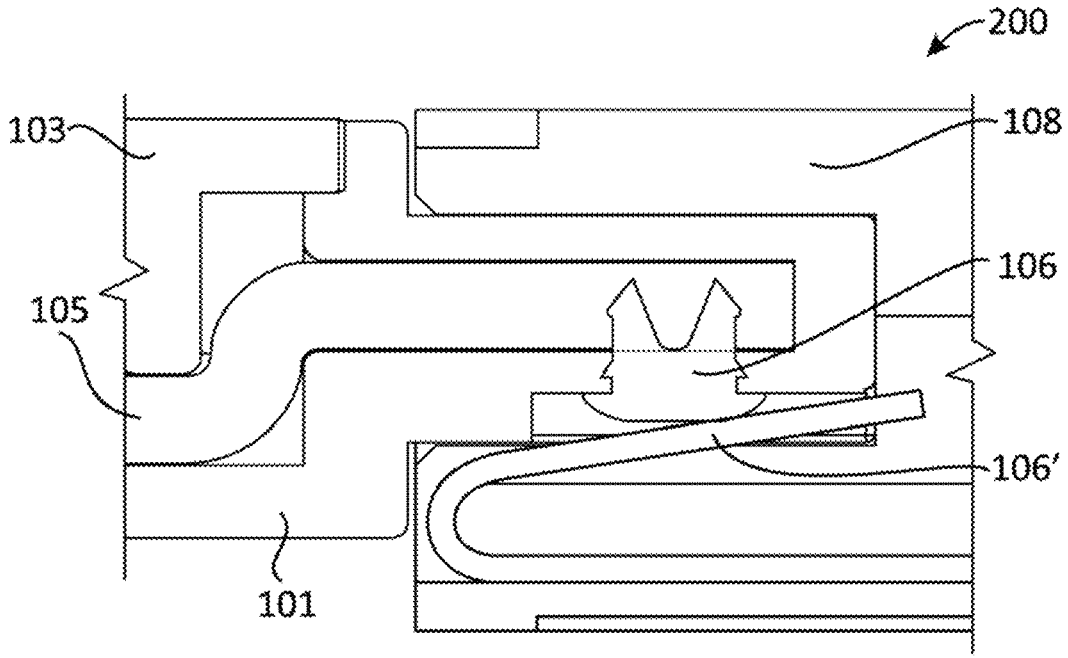
FIG. 4 schematically illustrates a cross section view of the first electrical connector element of FIG. 3 being coupled and connected to one embodiment of a second electrical connector element.
Figure 5A:
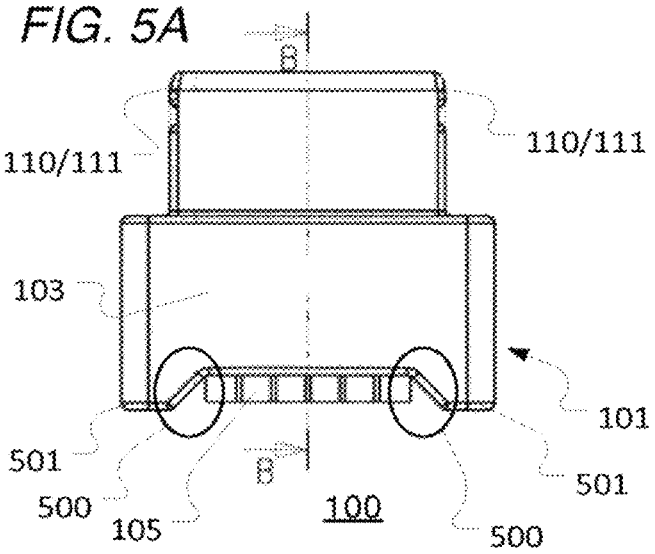
FIGS. 5*a*)-5*e*) schematically illustrates different views of yet another embodiment of a first electrical connector element.
Figure 5B:
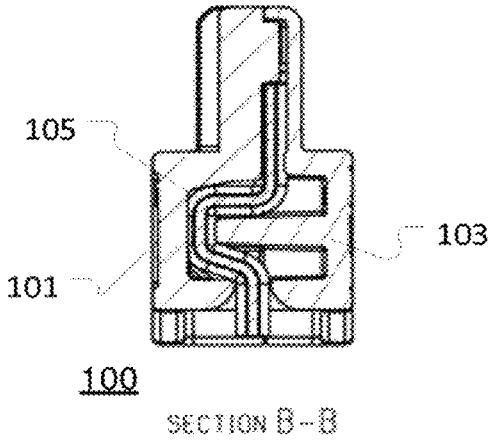
Figure 5C:
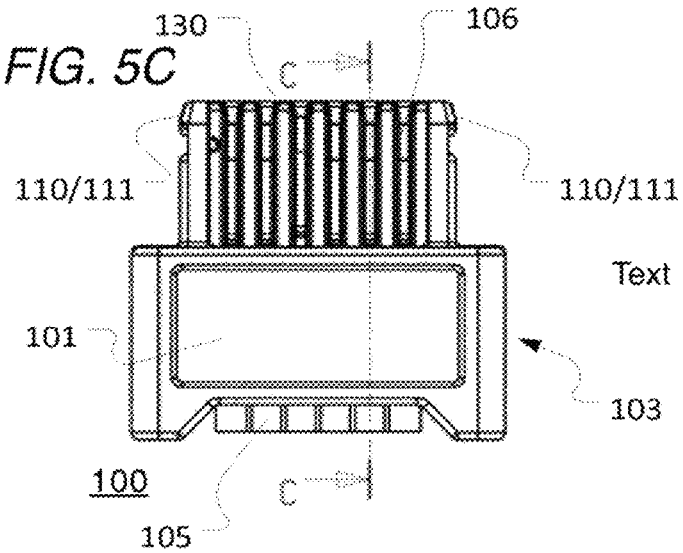
Figure 5D:
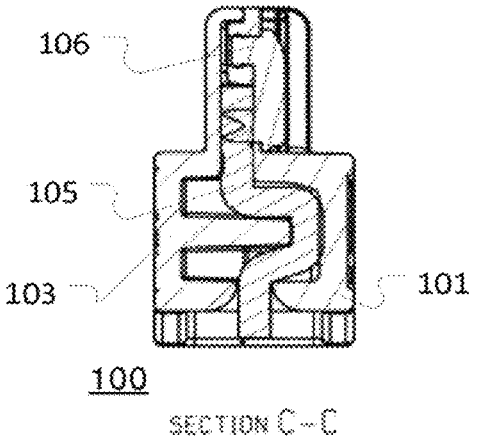

Embodiments of how the electrical contacts and the electrical conductors may be connected and arranged are shown and explained further e.g. in FIGS. 3, 4, and 5*d*). Specific embodiments of the types of electrical signals that may be communicated via the electrical conductors and contacts are shown and explained further e.g. in FIGS. 7, 8, and 9.

In some embodiments, the number of connectors and number of conductors are six and/or the conductors form a flexible flat cable. Alternatively, the conductors may be arranged as another type of cable but that will typically not be as flexible.

In addition, the first electrical connector element 100 further comprises a strain relief part 103. The strain relief part 103 is adapted to—when assembled with the first connector part 101 e.g. using ultrasonic welding—hold and bend the electrical conductors 105 securely (please see e.g. FIGS. 3 and 4 for further details). This provides a robust, reliable, and simple construction and further strengthen the connection between the electrical conductors 105 and the first electrical connector element 100 significantly.

The function of the strain relief part is further explained in the following and also illustrated and explained in connection e.g. with FIGS. 3, 4, and and 5*d*).

Instead of being assembled together, the strain relief part 103 and the first connector part 101 e.g. be formed by a single piece or element as an alternative.

Furthermore, the first electrical connector element 100 comprises a number of (in this particular and similar embodiments two) resilient lock and release elements 110 or the like. It is to be understood, that in other embodiments, the lock and release elements does not need to be resilient (e.g. as shown in FIGS. 5*a*)-5*d*)).

The resilient lock and release elements 110 are adapted to engage with the second electrical connector element 200 when the first and the second electrical connector elements 100; 200 are mechanically connected thereby mechanically coupling the first and the second electrical connector elements 100; 200 together and forming an electrical connection between them with their respective electrical contacts 106; 106' as will be explained further in the following.

In this particular and similar embodiments (e.g. like the ones shown in connection with FIGS. 2 and 5), the resilient lock and release elements 110 are further adapted to release the coupling between the first and/or the second electrical connector elements 100; 200 by being subjected to one or more pull forces, e.g. by being pulled by a user e.g. pulling the electrical conductors 105 (e.g. in the form of the wire or cable) or pulling one or both of the first and second electrical connector elements 100; 200 away from the other or each other. The resilient lock and release elements 110 and its lock and release function will be described further below after having described the second electrical connector element.

This provides a very easy and intuitive way for a given user of separating the first and second electrical connector elements 100; 200 from each other again, in particular by pulling the electrical conductors 105. Especially so, if the user is a child or a relatively young child and the connector elements are used in modular construction elements and/or systems (not shown; see e.g. 300 in FIGS. 10 and 11).

The lock and release function provided by the resilient lock and release elements 110 function especially advantageously together with the strain relief part 103 since the strain relief part 103 secures and bends the electrical conductors 105 thereby strengthening the connection between the electrical conductors 105 and the first electrical connector element 100 significantly enabling it to be able to withstand pull forces from a given user (both children and adults) even after repeated use.

Basically, when the electrical connectors 105 are pulled by a user, whereby a resulting force being larger than a predetermined release threshold of the resilient lock and release elements 110, the resilient lock and release elements 110 will release (the first connector element 100 from the second 200) before the strain relief part 103 releases the electrical connectors 105 from the first connector element 100 by a very large margin, i.e. the release threshold of the resilient lock and release elements 110 are lower (even significantly so) than a release threshold, as mainly provided by the strain relief part 103, between the electrical connectors 105 and the first connector element 100.

When a user is pulling sufficiently, a resulting force in an un-mating direction (where the un-mating direction is generally parallel and opposite to a mating direction) is applied that is larger than the predetermined release threshold of the resilient lock and release elements 110 thereby separating the first and second electrical connector elements 100; 200 from each other.

By being subjected to pull forces or one or more pull forces is to be understood as a resulting pull force (e.g. comprising a plurality of pull force components) being applied generally in the un-mating direction.

In some embodiments, the predetermined release threshold of the resilient lock and release elements is a member selected from the group consisting of: 5 or more Newton, 7.5 or more Newton, 10 or more Newton, and 15 or more Newton. The actual predetermined threshold may vary according to specific embodiment.

In some embodiments, the predetermined release threshold of the resilient lock and release elements is a value selected from the interval of about 5 to about 15 Newton (e.g. the interval of 5 to 15 Newton).

In some embodiments, the release threshold of (mainly) the strain relief part is 100 Newton or more.

This easy, reliable, and intuitive way of separating the first and the second connector elements are especially advantageous for modular construction elements/system as an inherent aspect of these are that the modular construction elements are to be put together and separated again many many times.

In some embodiments, the first and/or second electrical connector element 100; 200 is/are adapted to release from each other when being subjected to one or more pull forces being 15 or more Newton and adapted to not release from each other when being subjected to one or more pull forces being 5 or less Newton.

In some embodiments, the plurality of electrical conductors exits the first electrical connector element in a direction being substantially parallel to an un-mating direction. This facilitates reliable and intuitive un-mating or un-coupling of the first and second electrical connector elements from each other by a user pulling the plurality of electrical conductors (or wire, cable, etc. comprising the electrical conductors) since the resulting pulling force, by pulling the electrical conductors, generally will be coinciding with the un-mating direction.

As mentioned, FIG. 1 also illustrates a second electrical connector element 200 comprising a housing or main part 108 comprising a plurality of electrical contacts 106', e.g. in the form of metal terminals or the like, and a plurality of electrical conductors (not shown; see e.g. 105' in FIG. 6) e.g. in the form of rigid metal wires or the like for mounting or connection.

The second electrical connector element 200 in the shown exemplary embodiment further comprises at least one securing or mounting element 120 for securing or mounting the second electrical connector element 200 to something else. Examples of this are explained further in connection with FIG. 6.

In embodiments, where the first electrical connector element 100 is a male plug connector and the second electrical connector element 200 is a female jack connector, the second electrical connector element 200 also comprises an opening 102 receiving a protruding part of the first electrical connector element 100.

Inside this opening 102, the second electrical connector element 200 comprises a number of recesses, grooves, slits or the like 107' where each grooves, slit, etc. comprises one electrical contact 106' (explained further in relation to FIG. 4) of the second electrical connector element 200.

Correspondingly, the protruding part of the first electrical connector element 100 comprises a number of recesses, grooves, slits or the like (not shown; see e.g. 107 in FIG. 2) where each grooves, slit, etc. comprises one electrical contact (not shown; see e.g. 106 in FIGS. 2, 3, and 4) of the first electrical connector element 100.

When the first and second electrical connector elements are being coupled together, the protruding part will be inserted into the opening 102 and at least a part of the electrical contacts (not shown; see e.g. 106 in FIGS. 2, 3, and 4) will fit and slide into the recesses, etc. 107' of the second electrical connector element 200 (one contact in one recess, groove, slit, etc.) thereby guiding them so that the respective electrical contacts 106, 106' touches and establishes reliable electrical contact for each electrical conductor 105, 105' (see e.g. FIG. 4 for further details). This provides a secure and reliable coupling and also automatically aligns the respective electrical contacts of the first and second electrical connector elements appropriately. Additionally, this ensures that the first and second electrical connector elements 100, 200 cannot be coupled in a wrong way when one is inserted into the other.

The opening 102 in this and similar embodiments also has space to receive the resilient lock and release elements 110 of the first electrical connector element 100 when this is inserted into the second electrical connector element 200.

In embodiments like the ones shown in FIGS. 1-6 and 10 and corresponding embodiments, the resilient lock and release elements 110, each comprises an engaging portion, e.g. an engaging end portion, 111 and the second electrical connector element 200 further comprises a number (e.g. one for each resilient lock and release element 110) of receiving openings, recesses, or the like 112 (forth referred to as receiving opening) in the opening 102 for receiving at least the engaging portions 111 of the resilient lock and release elements 110.

In the embodiments of FIGS. 1-6 and 10 and corresponding embodiments, the engaging portions 111 of the resilient lock and release elements 110 snap into the receiving openings 112 due to the lock and release elements 110 being resilient and thus hold/lock the connectors 100, 200 in place until being sufficiently pulled apart, which will cause the engaging portions 111 to leave or pop out of the receiving openings 112 thus unlocking the connectors 100, 200.

Such resilient lock and release elements 110 may e.g. be snap pegs, springs or other resilient protrusions, etc. Alternatively, other resilient or non-resilient snap locks could be used (e.g. as shown in FIGS. 5*a*)-5*d*)).

Such snap fit connections furthermore provide a tactile connection confirmation upon use to the user.

The length of the resilient lock and release elements 110 may be substantially the same as the length of the rest of the protruding part (comprising the recesses, openings, etc. 107 and contacts 106), the lengths being measured from the strain relief part 103.

There is in these embodiments also a gap between the resilient lock and release elements 110 and the rest of the protruding part to allow for a spring effect of these elements 110.

It is to be noted, that the resilient lock and release element(s) 110 as an alternative could also be located in the second electrical connector element 200 with the receiving opening(s) 112 being located in the first electrical connector element 100, even a mix thereof with some resilient lock and release element(s) 110 and receiving opening(s) in one of the first and second electrical connector elements and a corresponding number of opposite elements and openings in the other of the first and second electrical connector elements.

Please see FIG. 6 for other different embodiments of the second electrical connector element 200.

Figure 2:
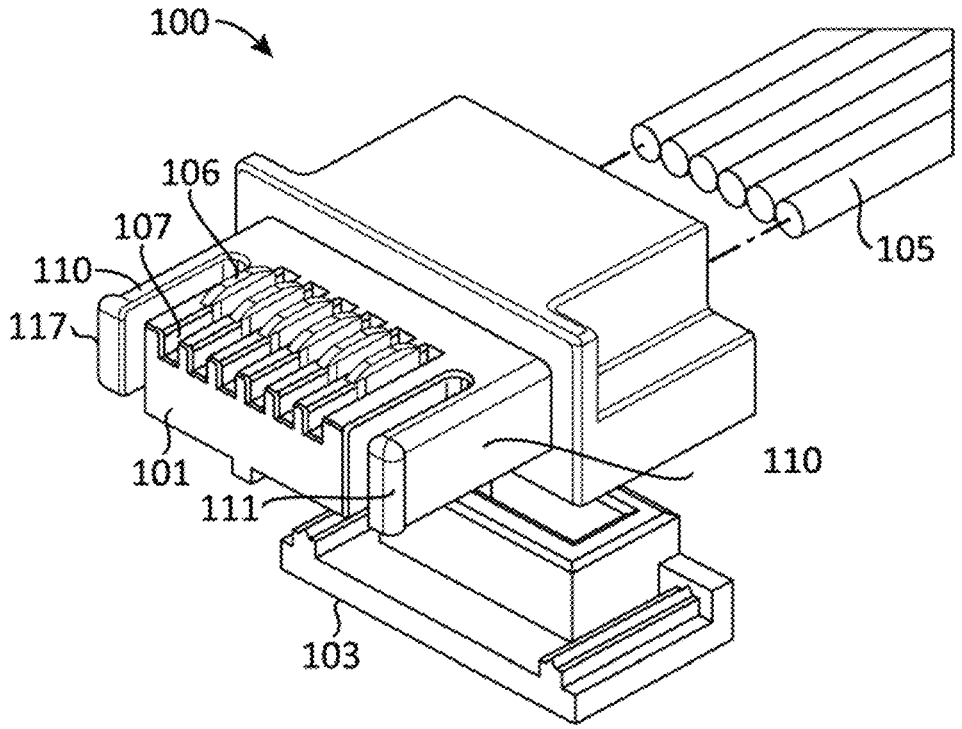
FIG. 2 schematically illustrates a partially exploded view of another embodiment of a first electrical connector element.

FIG. 2 schematically illustrates a partially exploded view of another embodiment of a first electrical connector element.

Shown is an exploded view of a first electrical connector element 100 corresponding in function and build to the one shown in FIG. 1 with the exceptions that the design of various parts are slightly different and that the resilient lock and release elements 110 have another type of engaging portion 111. The first electrical connector element 100 will work with a second electrical connector element as the ones shown in FIGS. 1, 4, and 6.

The first electrical connector element 100 shown here is shown from a different direction (here from an opposite side) than the one in FIG. 1.

In this figure, the strain relief part 103 is illustrated with more details.

FIG. 3 schematically illustrates a cross section of one embodiment of a first electrical connector element.

Shown is a first electrical connector element 100 corresponding to the ones of FIGS. 1, 2, and 10 where the cross section has been made at a perpendicular plane going through and being parallel with one of the electrical contacts 106 of the first electrical connector element 100.

This illustrates how the strain relief part 103 and the first connector part 101 securely hold and bend the electrical conductors 105, here in the form of a wire.

Please note, that the first electrical connector element 100 is shown before full or final assembly in that the electrical contact 106, herein the form of a metal terminal with sharp cutting points or blades. During assembly, these electrical contacts 106 will be pressed into the electrical conductor (like is shown in FIG. 4) establishing electrical connection between them and also securing the electrical conductors 105 additionally to the housing of the first electrical connector element 100.

FIG. 4 schematically illustrates a cross section view of the first electrical connector element of FIG. 3 being coupled and connected to one embodiment of a second electrical connector element.

Shown is the first electrical connector element 100 of FIG. 3 (now fully assembled) coupled together with and inserted into a second electrical connector element 200. Illustrated is how the electrical contacts 106, 106' establish an electrical connection. In certain embodiments, the electrical contacts 106' of the second electrical connector element 200 have a resilient leg (the one making contact) that may be pressed by the aligning contact 106 of the first electrical connector element 100 when the first electrical connector element 100 is coupled together with the second 200. This provides reliable electric contact between them.

FIGS. 5*a*)-5*e*) schematically illustrates different views of yet another embodiment of a first electrical connector element.

The shown first electrical connector element 100 corresponds to the ones explained in connection with FIGS. 1 and 2 and e.g. elsewhere with exceptions that the design of various parts is different and as further noted in the following.

Shown in FIG. 5*a*) is a top view of an embodiment of a first electrical connector element 100 to, during use, be mechanically, electrically, and releasably connected and coupled with a second electrical connector element (not shown) thus forming one embodiment of an electrical connector. Specifically, the first electrical connector element 100 is for use together with the second electrical connector element shown and explained in FIG. 12 (and corresponding ones).

The first electrical connector element 100 comprises a strain relief part 103 and a first or main connector part 101 (on the hidden side; see e.g. FIG. 5*c*) as well as a plurality of electrical contacts (not shown; see e.g. 106 in FIGS. 5*c*)-5*d*)) and a plurality of electrical conductors 105 as explained already in connection with the other embodiments.

The first electrical connector element 100 comprises a number of (in this example two) lock and release elements 110 adapted to engage with the second electrical connector element 200 when they are coupled together.

The lock and release elements 110 each comprises an engaging portion 111 for engaging with the second electrical connector element as explained already.

A difference to the first electrical connector elements e.g. shown in FIGS. 1 and 2 is that the lock and release elements 110 of the shown embodiment are not resilient and are not formed as separated legs or parts. Rather, the lock and release elements 110 of this and similar embodiments are integrated with general housing of the first electrical connector element and where each comprises a protruding portion or part (e.g. formed by a recess or cavity as shown) as the engaging portion 111 e.g. in the form of snap pegs or the like.

Another difference is the shape of the first electrical connector element 100 at its surface where the plurality of electrical conductors 105 exits the housing of the first electrical connector element. See e.g. the encircled areas 500 in FIG. 5*a*). As can be seen and comparing to FIGS. 1 and 2, a part of the housing now 'angles inwards' and defines an opening, recess, or cavity as shown that allows a suitably flexible plurality of electrical conductors 105 to easily bend as much as 90° (or more) upwards or downwards without extending further than the length of housing of the first electrical connector element. In other words, a housing of the first electrical connector element 100 comprises a recess, opening, cavity, etc. where the plurality of electrical conductors exits the housing where the recess allows the plurality of electrical conductors to bend, outside the housing, away from or across a mating direction (or correspondingly the parallel opposite un-mating direction) without extending further than a length of the housing in the mating direction.

Additionally, the housing of the first electrical connector element still has a portion 501 that is at least substantially flat.

Figure 11A:
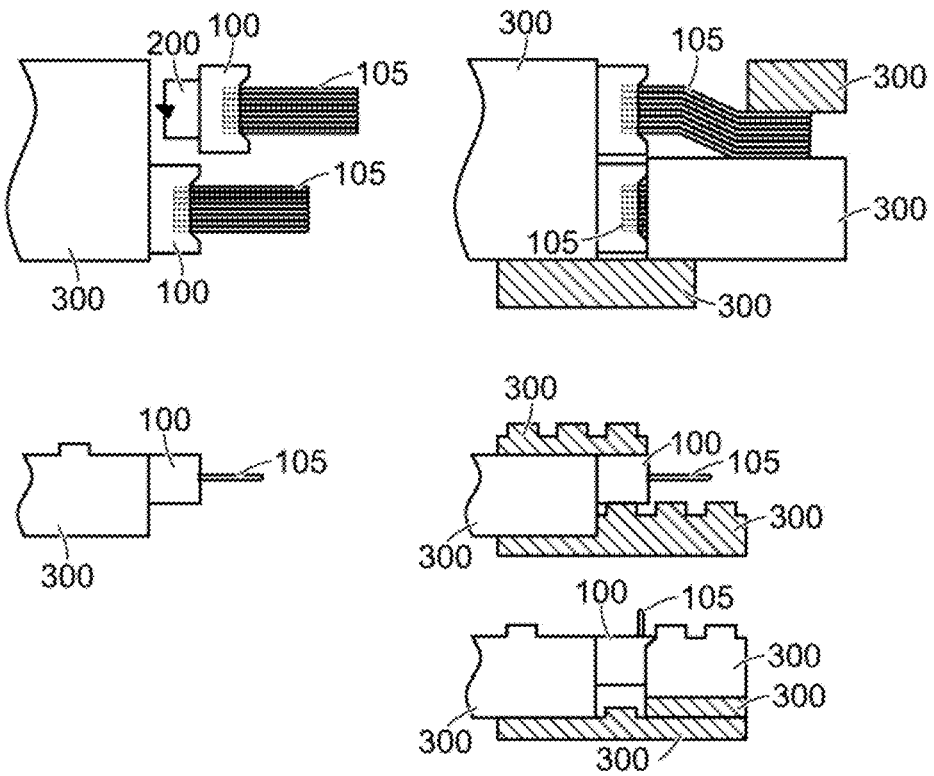
FIGS. 11*a*)-11*d*) schematically illustrate two embodiments of modular construction systems, each comprising a plurality of modular construction elements.
Figure 11B:
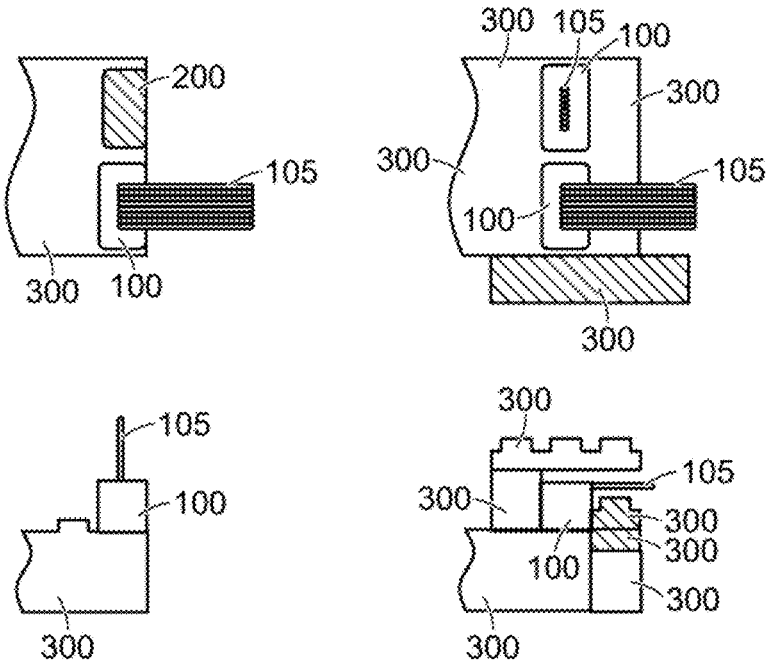
Figure 11C:
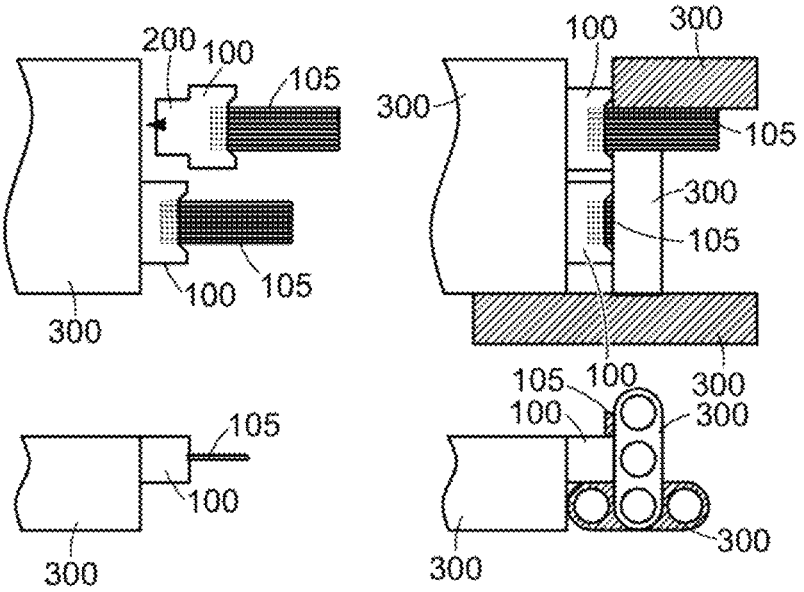
Figure 11D:
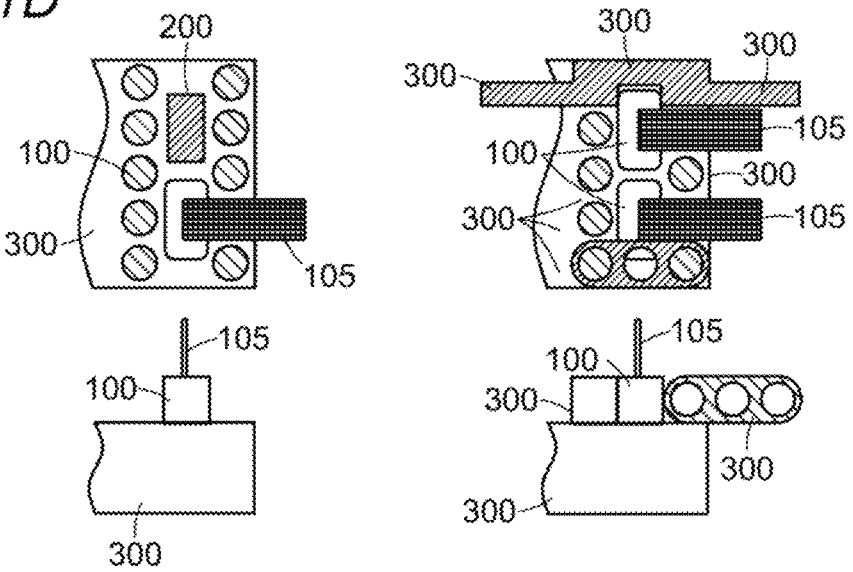

These features make it advantageous to use the first electrical connector element 100 with modular construction elements and/or systems of such modular construction elements as e.g. may be seen from FIGS. 11*a*)-11*d*) and in particular from the lower right image of FIG. 11*a*) showing the connector element 100 being located right next to a modular construction element and still allowing the conductors 105 (bending 90° upwards) to bend around the neighbouring modular construction element, the lower right image of FIG. 11*b*), the lower right image of FIG. 11*c*), and upper right image of FIG. 11*d*).

This allows for the use of modular construction elements and systems where a presence of electrical connector element(s) 100 will restrict the building possibilities, creativity, etc. the least.

Shown in FIG. 5*b*) is a cross section along line B-B in FIG. 5*a*) seen from the direction of the arrows pointing to line B-B. The line B-B is along one of the electrical conductors 105.

Shown is the first electrical connector element 100 of FIG. 5*a*) comprising the first or main connector part 101, the strain relief part 103, and one of the plurality of electrical conductors 105.

As can be seen, the first or main connector part 101 and the strain relief part 103 of this embodiment are different from the embodiments e.g. shown in FIGS. 1-4. In this particular and similar embodiments, the first or main connector part 101 and the strain relief part 103 are still adapted to—when assembled together—hold and bend the electrical conductors 105 securely but this embodiments holds and bends the electrical conductors 105 even more securely and provides an even more robust, reliable, and further strengthened connection between the electrical conductors 105 and the first electrical connector element 100.

More specifically, the electrical conductors 105 are bent in a u-shape and effectively bent four times while the electrical conductors 105 in the embodiments of FIGS. 1-4 are bent only twice.

In some embodiments, the strain relief part 103 is adapted to bend the plurality of electrical conductors 105 an even number of times. This allows that the general length-wise direction of the electrical conductors generally is parallel with the un-mating direction.

Shown in FIG. 5*c*) is a bottom view of the first electrical connector element 100 shown from the opposite side than in FIG. 5*a*) comprising the first or main connector part 101, the strain relief part 103 (on the hidden side; see e.g. FIG. 5*a*), a plurality of electrical contacts 106, the plurality of electrical conductors 105, and the lock and release elements 110 and engaging portions 111.

As can be seen, one of the electrical contacts 130 is offset compared to the other electrical contacts 106 in the direction of insertion into a second electrical connector element. Preferably, the offset electrical contact 130 is the electrical contact having, in use, an electrical ground potential (GND). In this particular embodiment and similar, the offset electrical contact 130 is the third electrical conductor or pin but could of course be a different one with other signal layouts.

The offset electrical contact 130 effectively ensures that this is reliably the first connector to make electrical contact.

Shown in FIG. 5*d*) is a cross section along line C-C in FIG. 5*c*) seen from the direction of the arrows pointing to line C-C. The line C-C is along one of the electrical contacts 106.

Shown is the first electrical connector element 100 of FIG. 5*c*) comprising the first or main connector part 101, the strain relief part 103, one of the plurality of electrical conductors 105, and one of the electrical contacts 106.

Again, the general bent u-shape of the electrical conductors 105 can be seen.

As also can be seen, the electrical contacts 106 are differently shaped than what is shown in FIGS. 3 and 4.

Figure 5E:
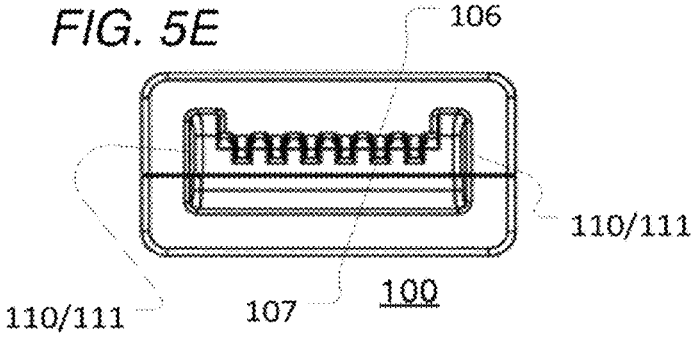

Shown in FIG. 5*e*) is a front view of the first electrical connector element 100 comprising the lock and release elements 110 and engaging portions 111 and a number of recesses, grooves, slits or the like 107 each comprising one of the electrical contacts 106.

It is to be understood, that even though the embodiment of a first electrical connector element 100 as shown in FIGS. 5*a*)-5*d*) has several additional or different features or aspects (opening/cavity 500, first or main connector part 101 and strain relief part 103, offset electrical contact 130, etc.) then one of these could be used in insolation in other embodiments of a first electrical connector element, e.g. like the ones shown in FIGS. 1-4 and variations thereof.

Figure 6A:
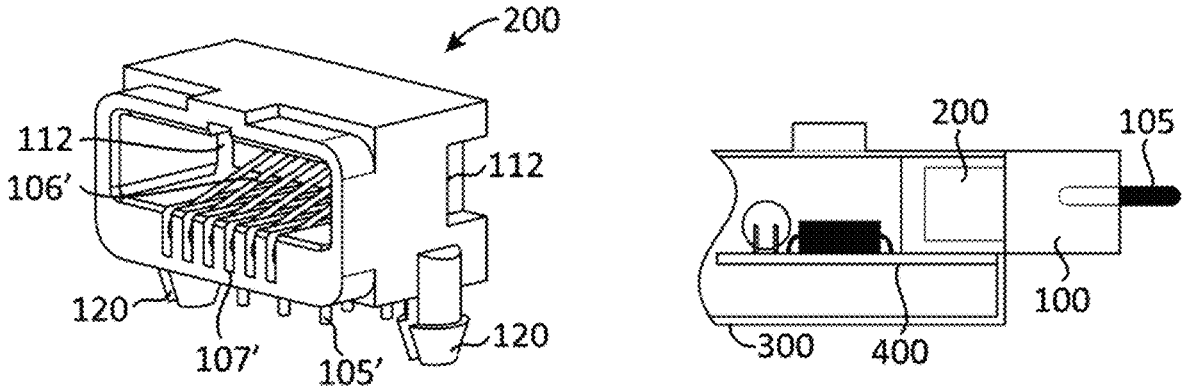
FIGS. 6*a*)-6*c*) schematically illustrate different embodiments of second electrical connector elements and how they e.g. may be mounted.

FIGS. 6*a*)-6*c*) schematically illustrate different embodiments of second electrical connector elements and how they e.g. may be mounted.

Shown are three different embodiments of a second electrical connector element 200 that correspond in function and overall design as the ones shown and described in connection with FIGS. 1, 4, and 10-12 with differences as noted in the following.

The differences are primarily relating to the securing or mounting elements 120 of the second electrical connector element 200 and how the conductors 105' are arranged.

The second electrical connector element 200 shown in FIG. 6*a*) corresponds to the one shown in FIG. 2 (which some small design differences) and in this and similar embodiments, the securing or mounting elements 120 are a peg or leg suitable for PCB (printed circuit board) mounting. The shown example is for top PCB mounting and the pegs or legs extend downwards as do the electrical conductors 105'.

Other embodiments may be designed for middle or bottom PCB mounting in which cases the securing or mounting elements (and the electrical conductors 105') would be located pointing back or up (instead of down as shown), respectively.

Figure 6B:
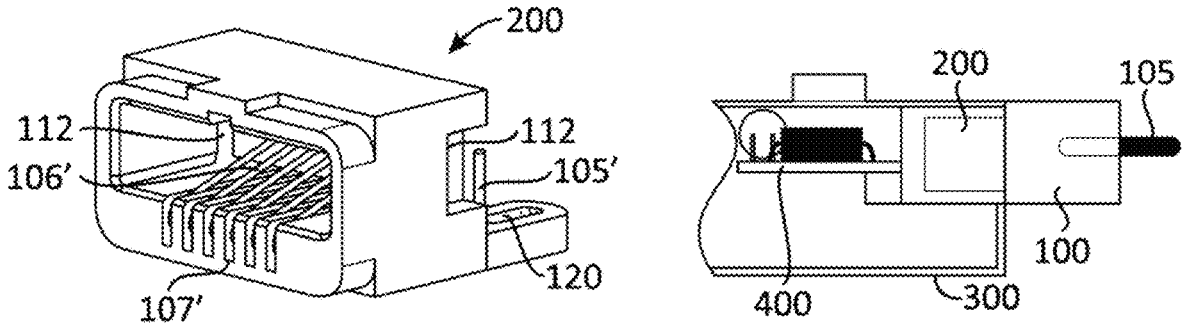

The second electrical connector element 200 shown in FIG. 6*b*) comprises securing or mounting elements 120 in the form of holes or cut-outs in a bottom backwards protruding part and is suitable for through hole mounting and SMD (surface mount device) soldering.

Figure 6C:
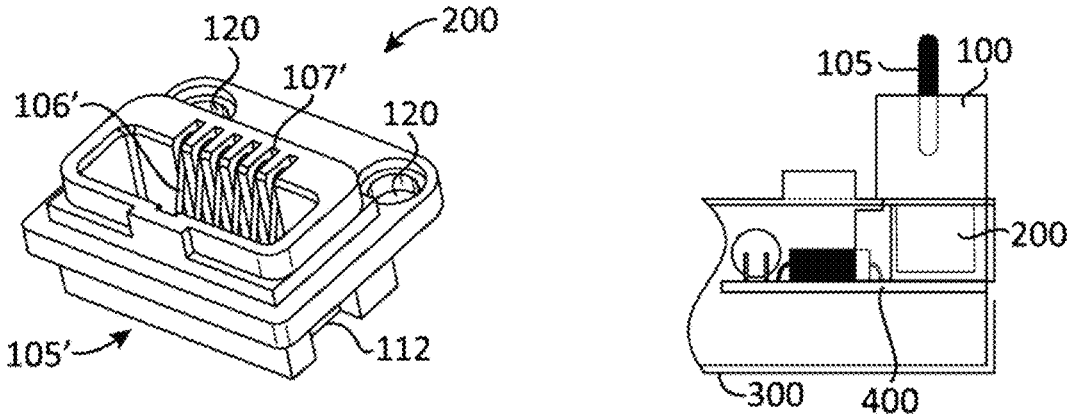

The second electrical connector element 200 shown in FIG. 6*c*) comprises securing or mounting elements 120 in the form of holes or cut-outs and the second electrical connector element 200 itself is mainly only the face or front compared to the other shown embodiments.

This embodiment and similar is suitable for side or top plug-in mounting.

Also schematically shown in FIGS. 6*a*)-6*c*) respectively, are examples of how the different second electrical connector elements 200 e.g. may be mounted on a PCB 400 where both the respective second electrical connector element 200 and the PCB 400 are comprised by a modular construction element 300.

A first electrical connector element 100 with its plurality of electrical conductors 105 is also shown as being coupled together with the respective second electrical connector element 200.

Figure 7A:
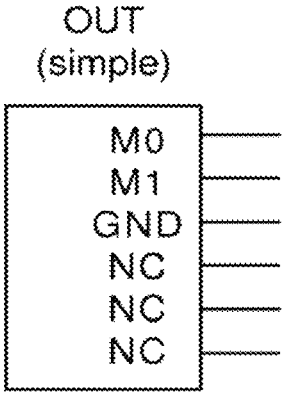
FIGS. 7*a*)-7*d*) schematically illustrate exemplary configurations of the electrical conductor signals of various embodiments of second electrical connector elements.

FIGS. 7*a*)-7*d*) schematically illustrate exemplary configurations of the electrical conductor signals of various embodiments of second electrical connector elements.

Shown in FIGS. 7*a*)-7*d*) are different exemplary configurations of the electrical conductor signals of a second electrical connector element, e.g. as explained in connection with and shown as 200 in FIGS. 1, 4, 6, 8, 10, 11, and 12. The shown configurations are for second electrical connector elements comprising six electrical conductors 105'.

In FIG. 7*a*), the shown exemplary configuration is for a second electrical connector element being configured as a simple output port with one signal being designated an M0 signal, one signal being an M1 signal, one signal being a GND signal and three signals being NC signals. This terminology is often used within motor control.

The M0 signal is a first device control signal, e.g. a first actuator, motor, sound generator, and/or light control signal or the like, provided, during use, at a first electrical conductor or pin; the M1 signal is a second device control signal, e.g. a second actuator, motor, sound generator, and/or light control signal or the like, provided, during use, at a second electrical conductor or pin; the GND signal is an electrical ground potential provided, during use, at a third electrical conductor or pin, and the NC signals are so-called 'Normally Closed' signals provided, during use, at third to sixth electrical conductors or pins, respectively.

In use, the M0 and/or the M1 signal may be used to provide basic control of a connected relatively low power electrical device, e.g. like a low power actuator like a mini, a small, or a medium sized motor, one or more light elements, one or more sound generators, etc. The M0 signal may e.g. be used to supply power and drive a connected electrical device, i.e. effectively being an on/off signal for that electrical device while supplying the necessary power to activate and run it. More specifically, M0 may be used to provide (e.g. unregulated) power with a relatively high output current to an electrical device e.g. as usable by a motor or other. The provided power may be continuous power or pulse width modulation (PWM) power and may e.g. be supplied in the range from about 5V to about 9V while output current may e.g. be supplied in the range from about 0.5 A to about 1.2 A depending on the connected electrical device.

Only second electrical connector elements located in an electrical device with its own power supply can provide power e.g. via the M0 signal.

In use, the M1 signal may be used to provide another control signal to the connected electrical device. This may e.g. for an actuator or a motor be a rotation or drive direction. The M1 signal may also be used to provide power as explained for the M0 signal as an alternative or an addition to the M0 signal.

The GND signal is for supplying an electrical ground potential while the NC signals are not used for the simple output port.

Figure 9A:
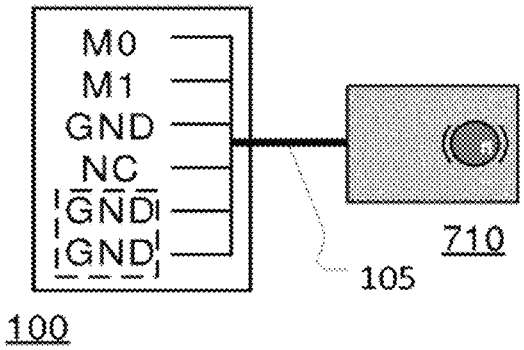
FIGS. 9*a*)-9*f*) schematically illustrate different exemplary connected electrical devices, each comprising a first electrical connector element, for connection with an electrical device, e.g. like the ones shown in FIGS. 8*a*)-8*e*)

Thus an output port or unit is provided that readily and simply can control a connected active electrical device (e.g. as shown in FIGS. 9*a*)-9*e*)) and supply required power if needed.

Figure 7B:
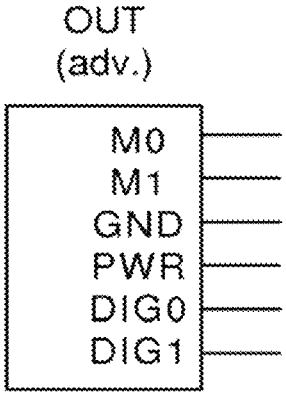

Illustrated in FIG. 7*b*) is a second electrical connector element being configured as an advanced output port with one signal being designated as an M0 signal, one signal being an M1 signal, one signal being a GND signal, one signal being a PWR signal, one signal being a DIG0 signal and one signal being a DIG1 signal, all provided, during use, at respective electrical conductors or pins.

M0, M1, and GND correspond to the M0, M1, and GND signals as described earlier (and may be provided, during use, at the same respective electrical conductors or pins) while the PWR signal is a power signal, provided, during use, at a fourth electrical conductor or pin, for supplying additional power, which may be needed or be advantageous for connected electrical components or systems requiring (additional) external power and/or power supplied in another form than as supplied by M0 and/or M1.

Furthermore, the DIG0 and DIG1 signals provide digital In/Out and/or digital communication at a given speed, e.g. from about 2.4 to about 115 kbaud e.g. depending on the requirements of the connected electrical device.

The DIG0 and DIG1 signals are provided, during use, at a fifth and sixth electrical conductor or pin, respectively. The DIG0 signal may be a transmission/Out signal and the DIG1 signal may be a reception/In signal. The DIG0/DIG1 signals may both be a UART (Universal Asynchronous Receiver/Transmitter) signal and/or digital I/O signals.

The PWR signal may supply regulated power at about 3.3V being limited to about 35 mA.

This provides—compared to the output port of FIG. 7*a*)—an output port that further is capable of receiving and transmitting information and/or supplying additional power for connected relatively high(er) power electrical devices.

The output port of FIG. 7*b*) is capable of the same functionality as the output port of FIG. 7*a*) (plus additional functionality as described) and may also function simply as a simple output port, e.g. depending on what specific type a connected electrical device is.

Figure 7C:
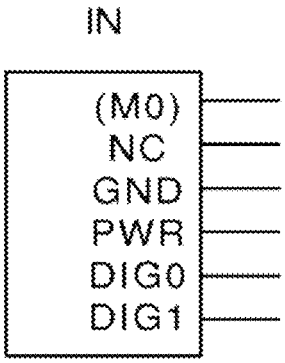

Illustrated in FIG. 7*c*) is a second electrical connector element being configured as an input port with one signal being designated an (M0) signal, one signal being an NC signal, one signal being a GND signal, one signal being a PWR signal, one signal being a DIG0 signal, and one signal being a DIG1 signal, all provided, during use, at respective electrical conductors or pins.

NC, GND, PWR, DIG0, and DIG1 correspond to the corresponding signals as described earlier. The (M0) signal correspond to an optional M0 signal in the sense that it may provide power to a connected electrical device, e.g. in the form of a sensor, activation device, etc. (e.g. in addition to a supplied PWR signal). If the connected electrical device has its own power supply or otherwise receives sufficient power from elsewhere, the M0 signal is not needed.

The DIG0 and DIG1 signals may—as for the advanced output port of FIG. 7*b*)—be used for digital communication with a connected electrical device and may obtain information e.g. like a state (on/off, active/not active, forward/backwards, etc.) and/or a number of a range of values or parameters for a connected electrical device.

Thus an input port or unit is provided that readily and simply can receive input or information from a connected electrical device, which then may be processed and/or communicated to other units.

Figure 7D:
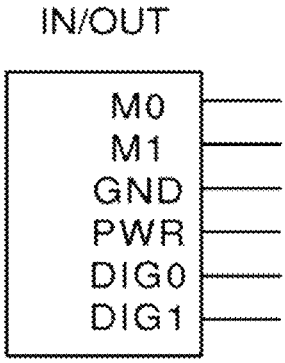

Illustrated in FIG. 7*d*) is a second electrical connector element being configured as a combined input/output port with one signal being designated an M0 signal, one signal being an M1 signal, one signal being a GND signal, one signal being a PWR signal, one signal being a DIG0 signal and one signal being a DIG1 signal, all provided, during use, at respective electrical conductors or pins.

M0, M1, GND, PWR, DIG0, and DIG1 correspond to the corresponding signals as described earlier.

In this way, an input/output port or unit is provided that readily and simply provides a combination of the capabilities of the input port and the output ports (both the simple and the advanced).

The port configurations of FIGS. 7*a*)-*d*) (out-simple; out-advanced; in; and in/out) readily provides the basic complete functionality/ports for supporting many different types of connected and interconnected electrical devices in a versatile way for a given system of electrical devices.

Furthermore, when the electrical layout of the electrical conductors/pins for the various types of ports are configured as described, the different ports is supported fully by a second electrical connector element and a corresponding first electrical connector element having only 6 electrical conductors/pins.

Additionally, the signal layout on the respective pins is compatible in the sense that a given pin signal is the same across all the different port configurations (or not used). E.g. first pin is M0 (or not used e.g. as for the input port), second pin is M1 (or not used for e.g. as for the input port), third pin is GND, etc. for all the different explained port configurations.

For these various port configurations it may for certain embodiments and uses be an advantage that the (output, input, input/output) port can identify what specific type of (connected) electrical device is actually connected to the given port. This may be realised in different ways.

According to an aspect, using one, more or all of the above mentioned port configurations, identification of a connected electrical device may be provided using the DIG0 and/or DIG1 signal where an appropriate identifier or the like may be transmitted via digital communication by the connected electrical device to the respective port it is connected to upon connection and/or according to another scheme, e.g. like upon request. This does not provide identification of a connected electrical device for the simple output port.

As an alternative or in addition, identification of a connected electrical device may be provided by supplying a predetermined combination of signals to a given set electrical conductors or pins of the port, preferably at the electrical conductors or pins providing the DIG0 and DIG1 signals, e.g. at the fifth and sixth electrical conductors or pins, respectively. This enables identification of a connected electrical device for the simple output port as well and also another way of identification for the other ports. Such identification also allows for identification of connected electrical devices that does not necessarily comprise a microcontroller or similar.

According to this, receiving a GND signal at the fifth and a PWR signal at the sixth electrical conductors or pins may identify the connected electrical device as being of a first predetermined type, as an example being a low power actuator (such as a mini or small sized motor).

Receiving a PWR signal at the fifth and a PWR signal at the sixth electrical conductor or pin may identify the connected electrical device as being of a second predetermined type, as an example being a medium motor.

Receiving a PWR signal at the fifth and a GND signal at the sixth electrical conductor or pin may identify the connected electrical device as being of a third predetermined type, as an example being a train motor.

Receiving a GND signal at the fifth and a GND signal at the sixth electrical conductor or pin may identify the connected electrical device as being of a fourth predetermined type, as an example being a high power actuator (such as a large motor, extra-large motor, or a polarity switch).

Shorting or short-circuiting the fifth and the sixth electrical conductors or pins and connecting them to GND using an appropriately valued resistor, i.e. an identification resistor, may identify the connected electrical device as being of a fifth predetermined type, as an example being a simple touch sensor, button, activation switch, and/or the like. Using differently valued resistors may identify the connected electrical device as being of another predetermined type according to the value of the resistor.

Other predetermined signal combinations, e.g. the fifth electrical conductor or pin being an inversion of the sixth electrical conductor or pin or vice versa, may identify additional predetermined types.

Other or additional predetermined types may e.g. include a (simple) light element/emitter, a converter, sound generator, etc.

This provides a simple way of identification of a connected electrical device, simply by the connected electrical device applying the appropriate signal combinations at the appropriate pins whereby a connected electrical device then does not necessarily need to comprise a microcontroller or similar.

As mentioned above, this may be supplemented by identification using digital communication, i.e. to enable identification of additional (more than the five listed above) types of connected electrical devices.

Additionally, some connected electrical devices may also supply an identifier using a so-called ID resistor (i.e. a given resistor having a resistor value being unique for that type of electrical device), e.g. for analog sensors or the like.

It is to be understood that other signal types, signal combinations, and/or types of connected electrical devices in principle may be used according to given other embodiments and uses.

It is also to be understood that the ordering of which signals is expected at which electrical conductors or pins may be changed without a different effect, as long as it consistently is adhered to.

Figure 8A:
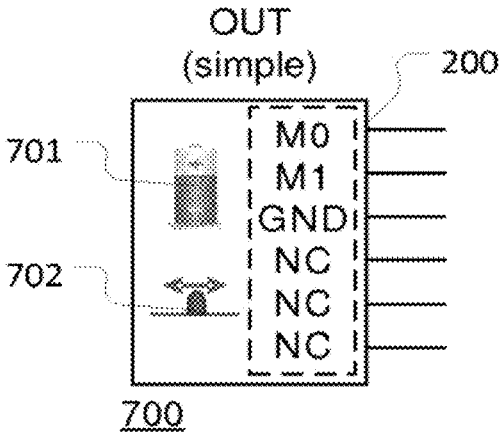
FIGS. 8*a*)-8*e*) schematically illustrate different electrical devices comprising one or more ports like the ones shown in FIGS. 7*a*)-7*d*)

FIGS. 8*a*)-8*e*) schematically illustrate different electrical devices comprising one or more ports like the ones shown in FIGS. 7*a*)-7*d*).

Shown in FIG. 8*a*) is an example of an electrical device 700 comprising a second electrical connector element 200 configured as a simple output port (as shown in FIG. 7*a*) and further comprising a power source 701, e.g. in the form of an internal battery, and a user input element 702, here as an example in the form of a simple switch having at least two states (e.g. on and off), controlling the signals of the port according to predetermined functionality.

In this way, an electrical device 700 is provided that may function as a power supply and a simple direct control device for a connected electric device connected by a first electrical connector element (not shown; see e.g. 100 in FIGS. 1-6 and 9-11) to the second electrical connector element. The simple control may e.g. be supplying power to the connected electric device from the power source 701 when the user input element 702 is in a first state (e.g. on) and not supplying any power when the user input element 702 is in a second state (e.g. off) but different functionality may of course also be provided.

Optionally, the electrical device 700 may also detect and identify what specific device is connected to it, preferably as described in connection with FIGS. 7*a*)-7*d*).

The connected electrical device (and the electrical device 700) may e.g. be an electric modular construction element (not shown; see e.g. 300 in FIG. 10), etc. having one or more functions (e.g. moving a part or element by a motor, turning on a lighting element, etc.) that can be activated and controlled by the electrical device 700 in a simple way.

Figure 8B:
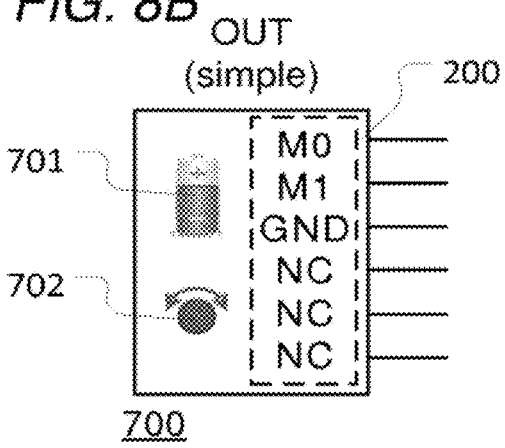

Shown in FIG. 8*b*) is an example of an electrical device 700 comprising a second electrical connector element 200 configured as a simple output port (as shown in FIG. 7*a*). This electrical device correspond to the electrical device of FIG. 8*a*) with the difference that here the user input element 702 is dial or knob instead of a simple switch, e.g. being a continuous dial/knob or one having a given number of discrete states.

The simple direct control of this electrical device may e.g. not be supplying any power when the dial is in an off position and then gradually supplying more and more power to the connected electric device as the dial is turned further away from its off position.

This may e.g. energise a motor, a light element, etc. comprised by a connected electric device and controls the speed of the motor, how much light the light element emits, etc. by turning the dial appropriately.

Figure 8C:
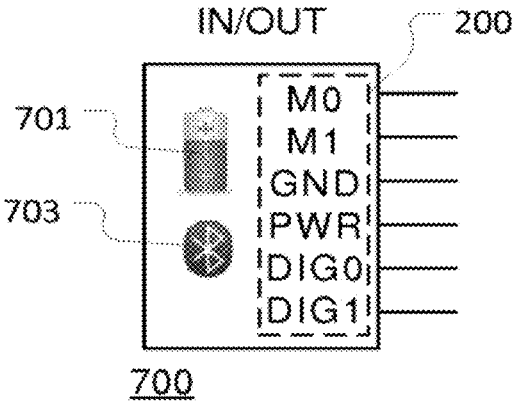

Shown in FIG. 8*c*) is an example of an electrical device 700 comprising a second electrical connector element 200 configured as an advanced input/output port (as shown in FIG. 7*d*) and further comprising a power source 701, e.g. in the form of one or more internal batteries, and (optionally) a wireless communications element 703, here as an example in the form of a Bluetooth communications element.

Such an electrical device 700 may provide hub functionality and may e.g. be a 2 port hub (then comprising 2 input/output ports) also providing wireless communications capabilities (when comprising the wireless communications element 703).

Such an electrical device 700 may e.g. receive input from a sensor (via one input/output port) and transmit the input wirelessly to another electrical device and/or use the received input to control another connected electrical device, being capable of performing one or more actions or functions, connected via the other input/output port. Furthermore, the wireless communications element 703 may also be used to wirelessly receive control signals from a user e.g. from a remote control handset, a smart phone using an appropriate app, etc. and control a connected electrical device accordingly e.g. in real-time.

Figure 8D:
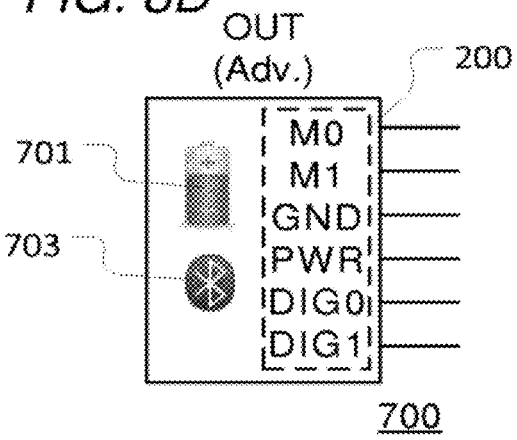

Shown in FIG. 8*d*) is an example of an electrical device 700 comprising a second electrical connector element 200 configured as an advanced output port (as shown in FIG. 7*b*) and further comprising a power source 701, e.g. in the form of one or more internal batteries and (optionally) a wireless communications element 703, here as an example in the form of a Bluetooth communications element.

Such an electrical device 700 may provide hub functionality and may e.g. be a 4 port hub (then comprising 4 output ports) also providing wireless communications capabilities (when comprising the wireless communications element 703).

Like mentioned in connection with FIG. 8*c*), the wireless communications element 703 may also be used to wirelessly receive control signals and control a connected electrical device accordingly.

Figure 8E:
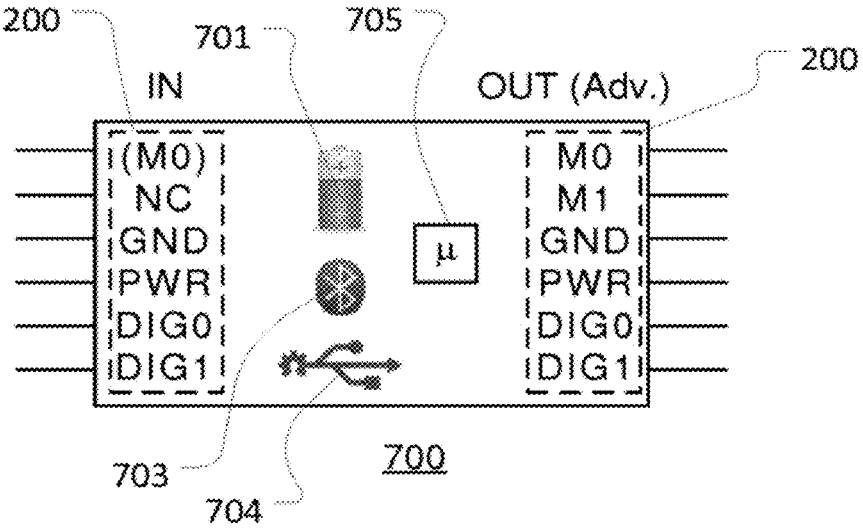

Shown in FIG. 8*e*) is an example of an electrical device 700 comprising a number of second electrical connector elements 200 where some is/are configured as an advanced output port (as shown in FIG. 7*b*) and some is/are configured as an input port (as shown in FIG. 7*c*). The electrical device 700 further comprises a power source 701, e.g. in the form of one or more internal batteries and (optionally) a wireless communications element 703, here as an example in the form of a Bluetooth communications element, and (optionally) one or more standard connectors 704, here as an example in the form of one or more USB ports.

This electrical device 700 further comprises one or more microprocessors or the like 705 for providing processing functionality in the electrical device.

Such an electrical device 700 may e.g. provide an 'intelligent' control unit (e.g. a programmable electric modular construction element) that can receive input from a number of connected electrical devices via the input port(s) and control a number of connected electrical devices via the output port(s) while being able to run executable code and communicate with other devices wirelessly and/or using the standard connectors.

The executable code may be downloaded, e.g. via the wireless communications element 703 and/or the one or more standard connectors 704, and run by the processor(s) 705.

As an example, the electrical device 700 of FIG. 8*e*) may comprise 4 input ports, preferably supporting both analog and digital input, and 3 output ports.

For the embodiments of FIGS. 8*a*)-*d*), a connected electrical element may e.g. be an electric modular construction element (not shown; see e.g. 300 in FIG. 10), etc. having one or more functions (e.g. moving a part or element using a motor, turning on a lighting element, etc.) that can be activated and controlled by an electrical device 700 and/or providing input or information to an electrical device 700.

Furthermore, the electrical device 700 itself may also be an electric modular construction element (not shown; see e.g. 300 in FIG. 10), etc.

As an alternatively, the power source 701 may also be an external power source for one or more embodiments of the electrical device(s).

FIGS. 9*a*)-9*f*) schematically illustrate different exemplary connected electrical devices, each comprising a first electrical connector element, for connection with an electrical device, e.g. like the ones shown in FIGS. 8*a*)-8*e*).

Shown in FIG. 9*a*) is a connected electrical device 710 comprising a first electrical connector element 100 and electrical conductors 105 for connection with a second electrical connector element of an electrical device, e.g. as shown in FIGS. 8*a*)-8*e*).

In this particular example, the connected electric device 710 is a simple relatively low power motor.

As can be seen, the connected electrical device 710 is configured, during use, to have an M0 signal (at a first electrical conductor or pin), an M1 signal (at a second electrical conductor or pin), three GND signals (at third, fifth, and sixth electrical conductors or pins, respectively), and one NC signal (at a fourth electrical conductor or pin).

M0, M1, GND, and NC correspond to the corresponding signals as described earlier.

The M0 and M1 signals are first and second device control signals and may be used to control connected electrical device 710 as described earlier.

As can be seen, the particular type of connected electric device 710 may be identified by having a GND signal (like it was described above in connection with FIGS. 7*a*)-7*d*)) at two predetermined electrical conductors or pins, shown here as pin number 5 and 6.

If such a connected electrical device 710 is connected to an electrical device with a simple output port (e.g. as shown in FIG. 8*a*) or 8*b*)), the connected electrical device 710 may be controlled using the M0 and/or M1 signals. Such a simple output port may not obtain the ID from the connected electrical device 710.

However, if the connected electrical device 710 is connected to an electrical device with an advanced output or input/output port (e.g. as shown in FIGS. 8*c*)-8*e*)), the ID may also be determined using the supplied signals on pins number 5 and 6 as described earlier.

Figure 9B:
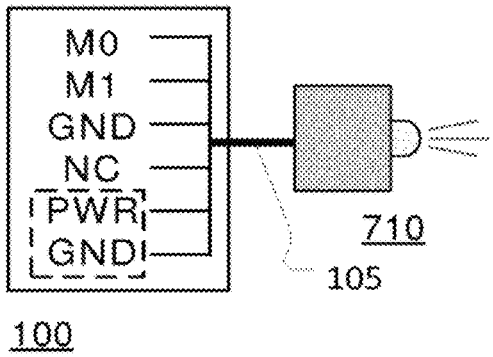

Shown in FIG. 9*b*) is a connected electrical device 710 comprising a first electrical connector element 100 and electrical conductors 105 for connection with a second electrical connector element of an electrical device, e.g. as shown in FIGS. 8*a*)-8*e*).

In this particular example, the connected electric device 710 is a relatively simple light element.

As can be seen, the connected electrical device 710 is configured, during use, to have an M0 signal (at a first electrical conductor or pin), an M1 signal (at a second electrical conductor or pin), two GND signals (at third and sixth electrical conductors or pins, respectively), one NC signal (at a fourth electrical conductor or pin), and one PWR signal (at a fifth electrical conductor or pin).

M0, M1, GND, PWR and NC correspond to the corresponding signals as described earlier.

Again, the particular type of connected electric device 710 may be identified by capable output ports, as described earlier, by supplying a PWR and a GND signal to two predetermined electrical conductors or pins, shown here as number 5 and 6.

Figure 9C:
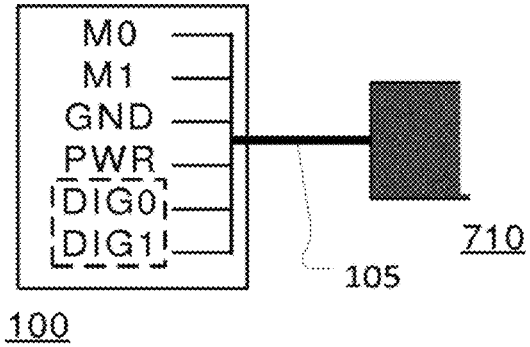

Shown in FIG. 9*c*) is a connected electrical device 710 comprising a first electrical connector element 100 and electrical conductors 105 for connection with a second electrical connector element of an electrical device, e.g. as shown in FIGS. 8*a*)-8*e*).

In this particular example, the connected electric device 710 is a relatively advanced motor like an advanced servo motor also receiving additional power via the PWR signal if needed.

As can be seen, the connected electrical device 710 is configured, during use, to have an M0 signal (at a first electrical conductor or pin), an M1 signal (at a second electrical conductor or pin), a GND signal (at third electrical conductor or pin), a PWR signal (at a fourth electrical conductor or pin), and DIG0 and DIG1 signals (at fifth and sixth electrical conductors or pins, respectively).

M0, M1, GND, PWR, DIG0, and DIG1 correspond to the corresponding signals as described earlier.

Once more, the particular type of connected electric device 710 may be identified, as described earlier, by supplying appropriate identification DIG0 and/or DIG1 signals at two predetermined electrical conductors or pins, specifically shown as number 5 and 6, using digital communication. For connected electrical devices, e.g. comprising a micro controller, processor, and/or the like, that is controlled through digital communication it is an advantage to use digital communication for identification of the connected electrical device as well as it is readily available.

Figure 9D:
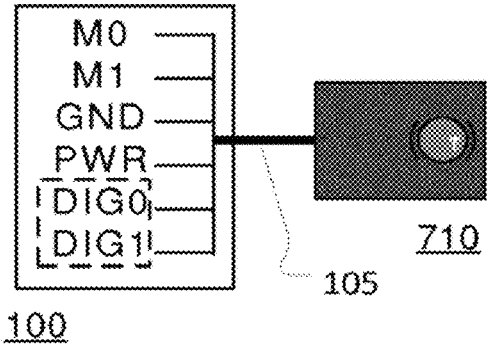

Shown in FIG. 9*d*) is a connected electrical device 710 comprising a first electrical connector element 100 and electrical conductors 105 for connection with a second electrical connector element of an electrical device, e.g. as shown in FIGS. 8*a*)-8*e*).

In this particular example, the connected electric device 710 is a relatively advanced motor like an advanced tacho motor also receiving additional power via a PWR signal if needed.

The elements of FIG. 9*d*) correspond to the elements of FIG. 9*c*) just with a different motor.

The particular type of connected electric device 710 may be identified, as described earlier.

The (active) connected electric devices 710 of FIGS. 9*a*)-9*d*) may be controlled with the M0 and/or M1 control signal(s).

Active connected electric devices 710, i.e. being capable of performing one or more actions or functions in response to received input, like the ones shown in FIGS. 9*a*-9*d*), may be controlled from output (simple or advanced) or input/output ports.

Figure 9E:
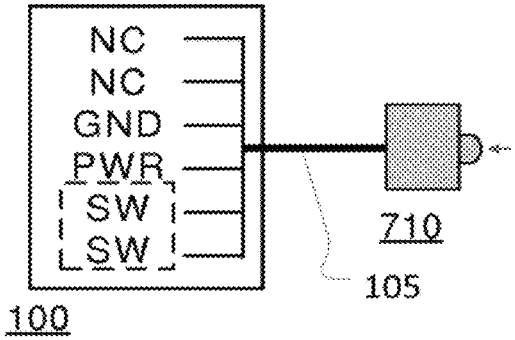

Shown in FIG. 9*e*) is a connected electrical device 710 comprising a first electrical connector element 100 and electrical conductors 105 for connection with a second electrical connector element of an electrical device, e.g. as shown in FIGS. 8*a*)-8*e*).

In this particular example, the connected electric device 710 is a sensor in the form of an analog touch-based switch.

Sensors are generally able to provide at least one sensor input and may preferably be identified (to an electrical device 700) as described earlier.

The particular type of connected electric device 710 may be identified, as described earlier, by supplying an appropriate signal (SW) at electrical conductors or pins 5 and 6.

As mentioned earlier, this may e.g. be done by shorting or short-circuiting the fifth and the sixth electrical conductors or pins and connecting them to GND using an appropriately valued (identification) resistor indicating this particular type of switch.

Figure 9F:
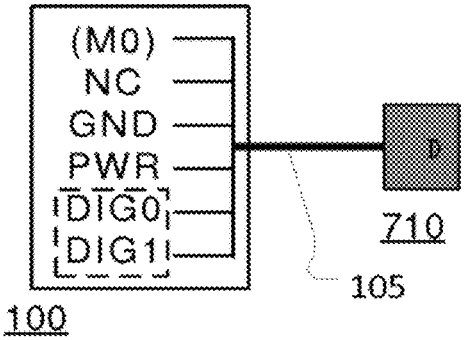

Shown in FIG. 9*f*) is a connected electrical device 710 comprising a first electrical connector element 100 and electrical conductors 105 for connection with a second electrical connector element of an electrical device, e.g. as shown in FIGS. 8*a*)-8*e*).

In this particular example, the connected electric device 710 is a sensor in the form of a digital sensor that may provide one or more digital representations of one or more measured or sensed parameters to an electrical device 700.

The particular type of connected electric device 710 may be identified, as described earlier using digital communication.

Connected electric devices 710 being sensors, i.e. being capable of providing input e.g. like the ones shown in FIGS. 9*e*) and 9*f*), connect with input or input/output ports.

It is to be understood that even if a given connected electric device 710 has been described to connect to a given port it may equally well be connected to another port providing or supporting the same functionality (plus perhaps additional functionality), e.g. instead of being connected to a simple output port it could be connected to an advanced output port or to an input/output port, instead of being connected to an input port it could be connected to an input/output port, etc.

Figure 10A:
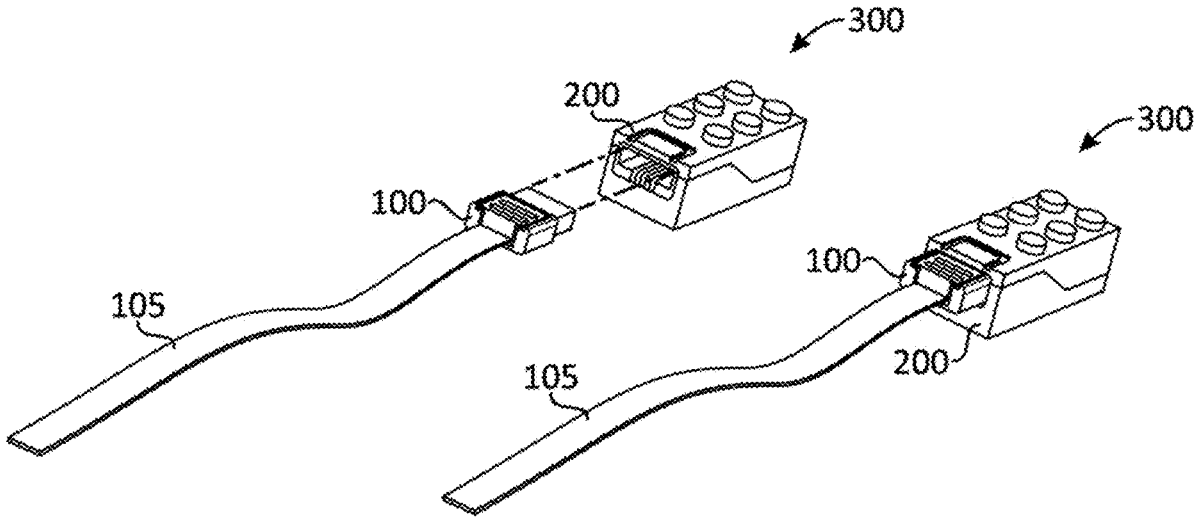
FIGS. 10*a*)-10*d*) schematically illustrate different embodiments of a first electrical connector element and a modular construction element comprising a second electrical connector element.

FIGS. 10*a*)-10*d*) schematically illustrate different embodiments of a first electrical connector element and a modular construction element comprising a second electrical connector element.

Shown in FIG. 10*a* is a perspective view of a modular construction element 300 comprising a second electrical connector element 200 and a first electrical connector element 100 comprising a number of electrical conductors 105, here in the form of a flexible flat cable comprising six electrical conductors.

The elements are shown in one situation, where the first and second electrical connector elements 100, 200 are disconnected and one situation where they are connected.

Figure 10B:
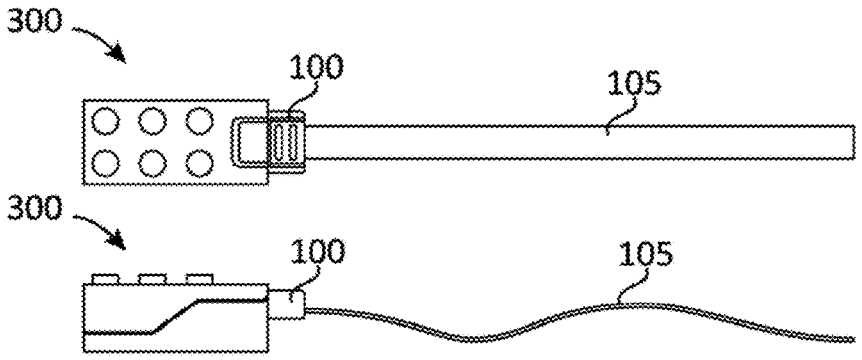

FIG. 10*b* illustrates a top and a side view of the elements of FIG. 10*a* in their connected state.

Figure 10C:
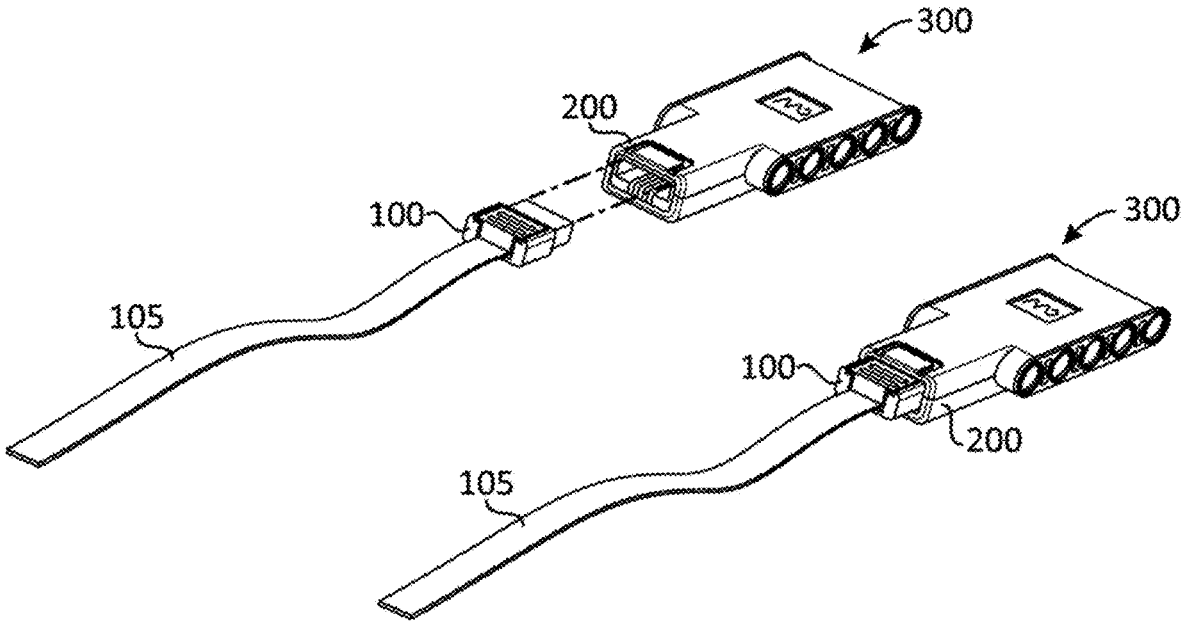

Shown in FIG. 10*c* is a perspective view of another type of modular construction element 300 than the one shown in FIGS. 10*a* and 10*b*. This modular construction element 300 likewise comprises a second electrical connector element 200. Further shown is a first electrical connector element 100 comprising a number of electrical conductors 105.

Again, the elements are shown in a disconnected and a connected state of the first and second electrical connector elements 100, 200.

Figure 10D:
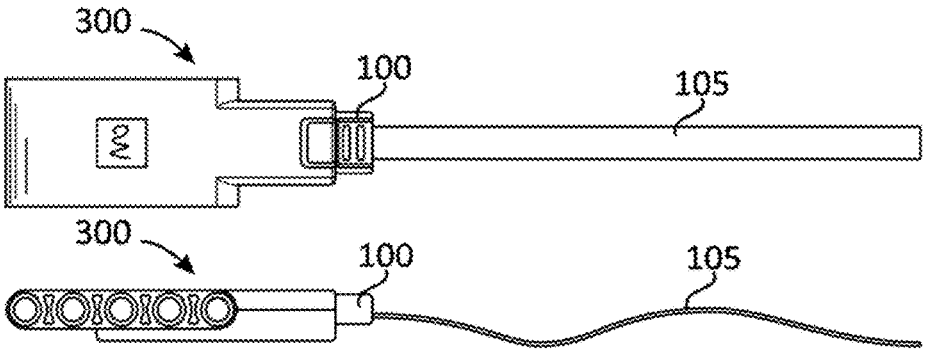

FIG. 10*d* illustrates a top and a side view of the elements of FIG. 10*c* in their connected state.

The difference between the FIGS. 10*a*-10*b* and FIGS. 10*c*-10*d* are only in the specific design (and thereby type) of the modular construction element.

The first electrical connector element 100 and the second electrical connector element 200 of FIGS. 10*a*-10*d* correspond to the first and second electrical connector elements and their embodiments and variations as described throughout the description.

As can be seen, a realisable size, as shown, of the first and second electrical connector elements 100, 200 are relatively small, even compared to an RJ12 or similar connector, making them very suitable for integration into certain existing lines of modular construction elements.

Such modular construction element 300 as shown may be used together with other modular construction elements (not necessarily comprising any connector elements although some may indeed do so) to form a modular construction system including electronic functions, etc.

Conductors in the form of a flexible (e.g. flat) cable may be advantageous, especially when used with at least two modular construction elements 300 comprising a second electrical connector element 200 and a flexible (e.g. flat) cable comprising a first electrical connector element 100 in each end, since the cable may connect the two modular construction elements 300 even if they are put on top of each other, next to each other, etc. due to the flexibility of the cable.

All or some of the modular construction elements 300 may comprise the port functionality as described in connection with FIGS. 7, and 8 and/or may comprise the connected electrical devices as described in connection with 710 in FIG. 9, e.g. a motor may be comprised by a modular construction element, etc.

By having a modular construction system comprising a number of modular construction elements where at least one element comprises a port and/or an electrical device, a very versatile modular construction system is provided with electric functionality having a modular and a constructional aspect.

FIGS. 11*a*)-11*d*) schematically illustrate two embodiments of modular construction systems—one embodiment in FIGS. 11*a*) and 11*b*) and one in FIGS. 11*c*) and 11*d*)—each system comprising a plurality of modular construction elements 300 wherein at least one of the plurality of modular construction elements 300 comprises an embodiment of a first electrical connector element 100 and/or an embodiment of a second electrical connector element 200 as described throughout this description and the claims.

In embodiments, as shown e.g. in FIGS. 11*a*)-11*d*) and elsewhere, where the conductors form a flexible flat cable, then the width of the flexible flat cable (i.e. the length of the conductors placed next to each other) may be at most about 8 mm.

Figure 12:
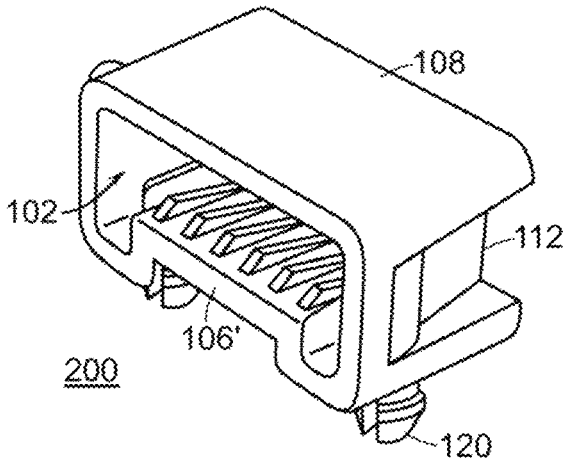
FIG. 12 schematically illustrates another embodiment of a second electrical connector.

FIG. 12 schematically illustrates another embodiment of a second electrical connector.

Shown is a perspective view of one embodiment of a second electrical connector element 200 adapted to receive a first electrical connector element as shown in FIGS. 5*a*)-*e*) as already described.

The second electrical connector element 200 comprises a housing or main part 108 comprising an opening 102 receiving a protruding part of a first electrical connector element. The opening 102 comprises a plurality of electrical contacts 106', e.g. in the form of metal terminals or the like, and a plurality of electrical conductors (not shown; see e.g. 105' in FIG. 6) e.g. in the form of rigid metal wires or the like for mounting or connection.

The second electrical connector element 200 further comprises a number (e.g. two as shown for this particular embodiment) of receiving openings or the like 112 in the opening 102 for receiving at least the engaging portions of the resilient lock and release elements (not shown; see e.g. 111 and 110 in the other relevant Figures) of a received first electrical connector element.

The second electrical connector element 200 further comprises at least one securing or mounting element 120 for securing or mounting the second electrical connector element 200 to something else. Examples of this are explained further in connection with FIG. 6.

The shown embodiment of a second electrical connector element 200 corresponds in function to other embodiments of second electrical connector elements as explained elsewhere (e.g. in connection with FIGS. 1, 4, 6, and 8-11) with differences as noted in the following.

The shown second electrical connector element 200 does not comprise any recesses or the like (e.g. like 107' in FIGS. 1 and 6) for receiving at least a part of the electrical contacts (see e.g. 106 in FIGS. 2, 3, and 4) of the first electrical connector element, which simplifies the design of the second electrical connector element 200.

The first electrical connector element and its electrical contacts are still guided appropriately when inserted; this is now simply done using the shape of the opening 102 and the mating shape of the protruding part of the first electrical connector element.

Another difference is the shape or profile of the electrical contacts 106' of the second electrical connector element 200. In the shown embodiment, the respective shapes are raised or bent 'upwards' at the ends closer to the first electrical connector element when received while in embodiments as shown e.g. in FIGS. 1, 4, and 6 they are raised towards the ends further/furtherst away. The shape as shown, enable a more reliable electrical connection between the contacts.

For embodiments mentioned throughout the present description, the number of conductors/the flexible cable may preferably comprise a first electrical connector element 100 at each end of the conductors/cable (unless one end is directly connected to a connected electrical device, e.g. as shown as 710 in FIG. 9) while a second electrical connector element 200 may be located in a number of modular construction elements 300 and/or electrical devices e.g. as shown as 700 in FIG. 8.

Alternatively, a second electrical connector element 200 may be located at each end of the conductors/the flexible cables with first electrical connector elements 100 being located in the modular construction elements and/or electrical devices.

A number of conductors/the flexible cable may also comprise a first electrical connector element 100 at one end and a second electrical connector element 200 at the other end.

In various embodiments, the first and/or second connector elements 100, 200 may e.g. be made of a generally transparent material.

Some preferred embodiments have been shown in the foregoing, but it should be stressed that the invention is not limited to these, but may be embodied in other ways within the subject matter defined in the following claims.

In the claims enumerating several features, some or all of these features may be embodied by one and the same element, component or item. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, elements, steps or components but does not preclude the presence or addition of one or more other features, elements, steps, components or groups thereof.

What is claimed is:

1. A first electrical connector element for a modular toy and/or educational toy construction element and/or toy construction system, the first electrical connector element comprising:

a first connector part comprising a plurality of electrical. contacts electrically connected to a plurality of electrical conductors, wherein the first electrical connector element is configured to be mechanically, electrically, and releasably connected with a second electrical connector element, and wherein the first electrical connector element further comprises:

a strain relief part configured to securely hold the plurality of electrical conductors thereby securing the plurality of electrical conductors to the first electrical connector element, and a number of lock and release elements configured to releasably engage with the second electrical connector element when the first and the second electrical connector elements are mechanically and electrically coupled together thereby releasably locking a coupling between the first and the second electrical connector elements and further being configured to release the coupling between the first and the second electrical connector elements when the plurality of electrical conductors is subjected to one or more pull forces above a predetermined release threshold.

2. The first electrical connector element according to claim 1, wherein the plurality of electrical conductors exit the first electrical connector element in a direction being substantially parallel to an un-mating direction of the first electrical connector element.

3. The first electrical connector element according to claim 1, wherein the predetermined release threshold is a member selected from the group consisting of: 5 or more Newton, 7.5 or more Newton, 10 or more Newton, and 15 or more Newton.

4. The first electrical connector element according to claim 1, wherein the first electrical connector element comprises two or more lock and release elements and/or wherein the lock and release elements comprises snap fit elements configured to fit with snap fit elements of the second electrical connector element.

5. The first electrical connector element according to claim 1, wherein the lock and release elements comprises pegs or resilient legs comprising an engaging portion configured to engage with a receiving opening or recess of the second electrical connector element when the first and the second electrical connector elements are mechanically and electrically coupled together.

6. The first electrical connector element according to claim 1, wherein a protruding part of the first electrical connector element is configured to be received in an opening of the second electrical connector element when the first and the second electrical connector elements are mechanically and electrically coupled together, where the protruding part comprises the electrical contacts, at least a part of the electrical conductors, and the lock and release elements.

7. The first electrical connector element according to claim 1, wherein the strain relief pan is configured to securely hold the plurality of electrical conductors when being assembled with the first connector part, and/for wherein the strain relief part is configured to bend the plurality of electrical conductors at least once, or twice, or four times, when securely holding the plurality of electrical conductors.

8. The first electrical connector element according to claim 1, wherein the second electrical connector element comprises:

a housing or main part comprising a second plurality of electrical contacts electrically connected to a second plurality of electrical conductors, wherein the second electrical connector element is configured to be mechanically, electrically, and releasably connected with the first electrical connector element, and wherein the second electrical connector element further comprises:

an opening configured to receive and engage with the number of lock and release elements of the first electrical connector element when the first and the second electrical connector elements are mechanically and electrically coupled together.

9. The first electrical connector element according to claim 8, wherein the opening is configured to release the coupling between the first and the second electrical connector elements when the second plurality of electrical conductors is subjected to one or more pull forces above the predetermined release threshold.

10. The first electrical connector element according to claim 9, wherein the second plurality of electrical conductors exit the second electrical connector element in a direction being substantially parallel to an tin-mating direction of the second electrical connector element.

11. The first electrical connector element according to claim 8, wherein the electrical device further comprises one or more of:

a power source, optionally configured for supplying power, via the second electrical connector element and/or the first electrical connector element, to a connected electric device, user input element, a wireless communications element, one or more standard connectors, and one or more microprocessors.

12. The first electrical connector element according to claim 1, wherein one of the plurality of electrical contacts of the first electrical connector element is offset compared to the other electrical contacts so that electrical connection for this electrical contact will he established before electrical connection for the others, during use, and where the offset electrical contact is the electrical contact having, in use, an electrical ground potential signal.

13. An electrical cable comprising the first electrical connector element according to claim 1 at a first end and a connected electric device at its other end.

14. The electrical cable according to claim 13, wherein the connected electric device is a device at least one of the following: a motor, a servo motor, a tacho motor, a lighting element, a sensor, an analog touch-based switch, a digital sensor, a linear actuator, a trigger and/or shooter element, an electro magnet, a relay, a sound generator and/or device, a display, a pneumatic valve, a pump, a light sensor, colour sensor, sound sensor, movement sensor, tilt sensor, distance sensor, acceleration sensor, position sensor, compass, direction sensor, pressure sensor, magnetism sensor, force sensor, near field communication detector, radio frequency communicator, and a remote control device.

15. The electrical cable according to claim 14, wherein the connected electric device is a modular toy or an educational construction element.

16. The electrical cable according to claim 14, wherein the first and the second electrical connector element each comprises:

a first electrical conductor, a second electrical conductor, a third electrical conductor, a fourth electrical conductor, a fifth electrical conductor, and a sixth electrical conductor, and wherein the first electrical device and the second electrical device are arranged to communicate:

a first device control signal, optionally supplying electrical power, or no signal via the respective first electrical conductors, a second device control signal or no signal via the respective second electrical conductors, an electrical ground potential signal via the respective third electrical conductors, a power supplying signal or no signal via the respective fourth electrical conductors, a first digital communications signal, e.g. a digital output signal, via the respective fifth electrical conductors, and a second digital communications signal, e.g. a digital input signal, via the respective sixth electrical conductors.

17. A first electrical connector element for a modular toy and/or educational toy construction element and/or toy construction system, the first electrical connector element configured for insertion into a second electrical connector element, the first electrical connector element comprising:

a connector interface having a plurality of metal terminals in electrical communication with a plurality of electrical wires, the electrical wires exiting the first electrical connector element in a direction substantially parallel to an un mating direction of the first electrical connector element;

a strain relief configured to securely hold the plurality of metal terminals by bending the plurality of metal terminals therein, securing the plurality of electrical wires to the connector interface; and a lock and release element configured to releasably engage with the second electrical connector element when the first and the second electrical connector elements are mechanically and electrically coupled together, the lock and release element configured to release from the second electrical connector element when the plurality of electrical wires is subjected to a pull force above a predetermined release threshold.

* * * * *